US008831448B2

(12) United States Patent
Yamashina

(10) Patent No.: US 8,831,448 B2
(45) Date of Patent: Sep. 9, 2014

(54) FIXING DEVICE, IMAGE FORMING APPARATUS, AND FIXING CONDITION CONTROL METHOD

(75) Inventor: Ryota Yamashina, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 108 days.

(21) Appl. No.: 13/064,172

(22) Filed: Mar. 9, 2011

(65) Prior Publication Data

US 2011/0222927 A1 Sep. 15, 2011

(30) Foreign Application Priority Data

Mar. 10, 2010 (JP) ..... 2010-053818

(51) Int. Cl.
*G03G 15/00* (2006.01)
*G03G 15/20* (2006.01)

(52) U.S. Cl.
CPC ..... *G03G 15/5029* (2013.01); *G03G 15/2078* (2013.01)
USPC ..... 399/44; 399/69

(58) Field of Classification Search
CPC ..... G03G 15/2039; G03G 15/2078; G03G 15/5029
USPC ..... 399/69, 44, 328
See application file for complete search history.

(56) References Cited

U.S. PATENT DOCUMENTS 4,367,037 A * 1/1983 Nishikawa ..... 399/69
6,390,696 B1 * 5/2002 Concannon ..... 400/120.01
6,728,497 B2 4/2004 Masuda et al.
6,987,251 B2 * 1/2006 Fukushi et al. ..... 219/619
8,509,675 B2 8/2013 Seto et al.
2002/0159785 A1 * 10/2002 Masuda et al. ..... 399/69
2005/0191070 A1 * 9/2005 Izawa et al. ..... 399/44

FOREIGN PATENT DOCUMENTS

JP 08-171303 7/1996
JP 3224169 B 8/2001
JP 3225156 B 8/2001
JP 2002-328560 11/2002
JP 2005-075602 3/2005
JP 2007183365 A 7/2007
JP 2007310337 A 11/2007
JP 2009-192836 8/2009
JP 2010-26131 2/2010

OTHER PUBLICATIONS

Abstract of Japanese Patent Publication No. JP07-121052 published on May 12, 1995.
Abstract of Japanese Patent Publication No. JP07-234606, published on Sep. 5, 1995.

* cited by examiner

*Primary Examiner* — Benjamin Schmitt
(74) *Attorney, Agent, or Firm* — Harness, Dickey & Pierce, P.L.C.

(57) ABSTRACT

A fixing device includes a temperature rise characteristic acquisition unit that acquires a temperature rise characteristic of a recording medium based on temperature change information of the recording medium acquired on a temperature basis of the recording medium detected by a temperature detection unit that detects the temperature of the recording medium, and a heat generation unit that generates a heat quantity provided to the recording medium in a fixing nip for fixing an image carried on the recording medium, that is adjusted on the basis of the temperature rise characteristic acquired by the temperature rise characteristic acquisition unit.

18 Claims, 11 Drawing Sheets

SOLID LINE: WHEN PRE-FIXING TRANSFER SHEET TEMPERATURE IS 30°C
DOTTED LINE: WHEN PRE-TRANSFER TRANSFER SHEET TEMPERATURE IS 50°C

FIXING DEVICE, IMAGE FORMING APPARATUS, AND FIXING CONDITION CONTROL METHOD

CROSS-REFERENCE TO RELATED APPLICATIONS

The present application claims priority to and incorporates by reference the entire contents of Japanese Patent Application No. 2010-053818 filed in Japan on Mar. 10, 2010.

BACKGROUND OF THE INVENTION

1. Field of the Invention

The present invention relates to a fixing device that is disposed in an image forming apparatus such as a copier, a facsimile, and a printer to appropriately heat a recording medium, thereby performing fixing in a fixing nip. The invention further relates to a fixing condition control method and an image forming apparatus having the fixing device.

2. Description of the Related Art

From the past, there has been known a fixing device that is disposed in an image forming apparatus such as a copier, a facsimile, and a printer. In the fixing device, the recording medium such as paper, on which an image formed with the use of toner is carried, passes through a fixing nip that includes a fixing member such as a fixing roller or a fixing belt and a pressing member such as a pressing roller. In the fixing nip, the recording medium is applied with heat and pressure, and as a result, the image is fixed onto the recording medium (for example, see Japanese Patent Application Laid-open No. 2007-183365, Japanese Patent Application Laid-open No. 07-121052, Japanese Patent Application Laid-open No. 07-234606, and Japanese Patent Application Laid-open No. 2007-310337 and Japanese Patent No. 3224169 and Japanese Patent No. 3225156).

In such fixing device, it is very important to appropriately apply, to the recording medium in the fixing nip, a heat quantity necessary to fix the image onto the recording medium. The reason is as follows. For example, if there is a shortage of a heat quantity applied to the recording medium in the fixing nip, the toner is insufficiently melted, so that a fixing failure occurs such as a phenomenon called a cold offset in which the image is not fixed onto the recording medium. On the other hand, if the heat quantity applied to the recording medium in the fixing nip is excessive, a fixing failure occurs such as a phenomenon called a hot offset in which the excessively melted toner is fixed to the fixing member and a phenomenon in which a degree of glossiness deviates from an appropriate range. Further, when the excessive heat quantity is applied, unnecessary power consumption occurs.

Thus, it is required to perceive the heat quantity appropriate for fixing the image onto the recording medium and perform the control thereof, so that the heat quantity provided to the recording medium in the fixing nip may be an appropriate heat quantity.

As a typical technique of controlling an input heat quantity, there has been known a technique for deciding a set temperature of the fixing member necessary for fixing in advance, attaching a temperature detection member such as a thermistor or a thermopile to the fixing member, and controlling power of a heat source so that the temperature of the temperature detection member may be a preset temperature. Further, as a technique of controlling the heat quantity without using the fixing set temperature, there may be considered a technique of controlling the heat quantity provided to the recording medium by changing the speed at which the recording medium passes through the fixing nip.

It has been known that the input heat quantity necessary for the fixing process depends on characteristics of the recording medium such as the basis weight of the recording medium, that is, the weight per unit area, the smoothness, or an amount of moisture content. As the basis weight increases, the heat capacity increases, and thus the input heat quantity needs to be increased. Regarding the smoothness, as the surface of the recording medium becomes rougher, the input heat quantity received in the fixing unit decreases, and thus the input heat quantity needs to be increased. As the amount of moisture content increases, an amount of depriving heat of the recording medium when moisture in the recording medium evaporates increases, and thus the input heat quantity needs to be increased.

It has been known that the basis weight, particularly among the characteristics of the recording medium, is very sensitive to setting of the input heat quantity.

Therefore, the following techniques have conventionally been suggested.

A technique in which the basis weight of the recording medium, on which fixing for image formation is performed, is perceived in advance on the basis of a paper type input by a user, for example, on the basis of whether the recording medium is a thick paper or a regular paper, and then the fixing set temperature is changed according to the perceived basis weight (for example, see Japanese Patent Application Laid-open No. 2007-183365).

A technique in which the basis weight of the recording medium, on which fixing for image formation is performed, is estimated on the basis of a temperature change of the fixing member, and then the fixing set temperature is changed according to the estimated basis weight (for example, see Japanese Patent Application Laid-open No. 07-121052 and Japanese Patent No. 3224169)

Further, a technique of changing the fixing set temperature based on a temperature change of the fixing member has been known (for example, see Japanese Patent Application Laid-open No. 2007-183365 and Japanese Patent Application Laid-open No. 07-234606 and Japanese Patent No. 3225156).

However, in the technique of changing the fixing set temperature using the basis weight of the recording medium perceived based on the paper type input by the user, when the user erroneously recognizes the paper type, there is a problem in that the fixing set temperature becomes inappropriate, so that a fixing failure occurs, and energy is wasted in some cases.

Further, in the technique of changing the fixing set temperature using the paper type of the recording medium estimated based on the temperature change of the fixing member, the temperature of the fixing member may change due to heat transfer of the fixing member itself, for example, heat transfer to the inside of the fixing member as well as absorption of heat by the recording medium. That is, since information that does not relate to the basis weight of the recording medium may be included in information for estimating the basis weight of the recording medium, a degree of accuracy of estimation is low, and the fixing set temperature becomes inappropriate. Thus, there is a problem in that a fixing failure occurs, and energy is wasted. This problem occurs similarly on the other techniques of changing the fixing set temperature based on the temperature change of the fixing member.

As described above, in the conventional technique of perceiving or estimating the basis weight of the recording medium, there has been a problem in recognizing the heat quantity appropriate for fixing. Further, a technique of using the smoothness or the amount of moisture content of the recording medium as information for recognizing the heat amount has not been suggested yet.

SUMMARY OF THE INVENTION

It is an object of the present invention to at least partially solve the problems in the conventional technology.

According to an aspect of the present invention, there is provided a fixing device, including: a temperature rise characteristic acquisition unit that acquires a temperature rise characteristic of a recording medium based on temperature change information of the recording medium acquired on a temperature basis of the recording medium detected by a temperature detection unit that detects the temperature of the recording medium; and a heat generation unit that generates a heat amount provided to the recording medium in a fixing nip for fixing an image carried on the recording medium, that is adjusted on the basis of the temperature rise characteristic acquired by the temperature rise characteristic acquisition unit.

According to another aspect of the present invention, there is provided an image forming apparatus including the fixing device including: a temperature rise characteristic acquisition unit that acquires a temperature rise characteristic of a recording medium based on temperature change information of the recording medium acquired on a temperature basis of the recording medium detected by the temperature detection unit that detects the temperature of the recording medium; and a heat generation unit that generates a heat amount that is adjusted on the basis of the temperature rise characteristic of the recording medium acquired by the temperature rise characteristic acquisition unit, that is provided to the recording medium in a fixing nip for fixing an image carried on the recording medium.

According to still another aspect of the present invention, there is provided a method of controlling fixing conditions, including: performing by a temperature rise characteristic acquisition unit acquisition of a temperature rise characteristic of a recording medium based on temperature change information of the recording medium acquired on a temperature basis of the recording medium detected by a temperature detection unit that detects the temperature of the recording medium; and adjusting a heat amount provided to the recording medium in a fixing nip for fixing an image carried on the recording medium based on the temperature rise characteristic acquired by the temperature rise characteristic acquisition unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
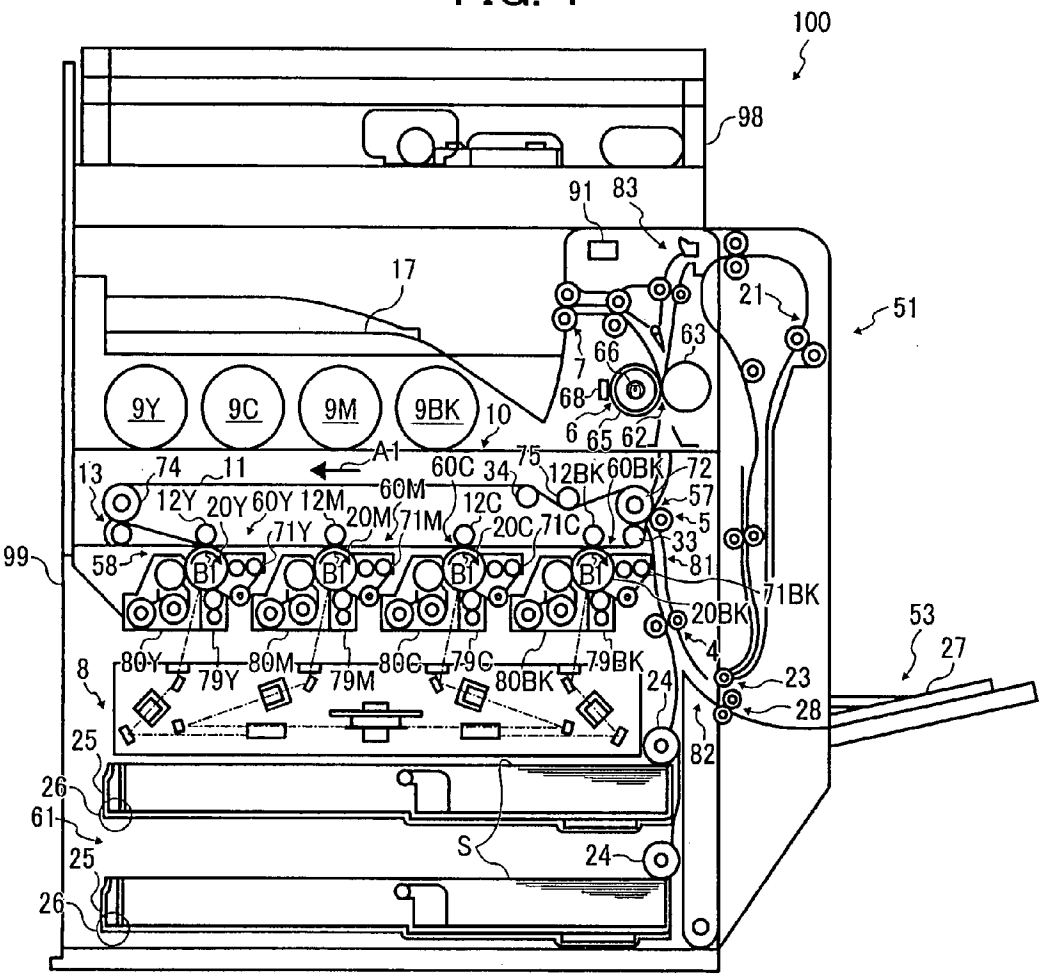
FIG. 1 is a schematic front view illustrating a fixing device and an image forming apparatus according to the invention.

FIG. 1 schematically illustrates an image forming apparatus according to the invention. An image forming apparatus 100 is a multifunction peripheral of a copy machine, a printer, and a facsimile and may perform full-color image formation. However, as the image forming apparatus 100, single-body image forming apparatuses such as a monochrome device, a copy machine, a printer, and a facsimile or other types of multifunction peripherals such as a multifunction peripheral of a copy machine and a printer may be used. When used as the printer, the image forming apparatus 100 performs an image formation process based on an image signal corresponding to image information received from the outside. This is similarly applied when the image forming apparatus 100 is used as the facsimile.

The image forming apparatus 100 may form an image on a sheet-like recording medium such as a thick paper such as an OHP sheet, a card, and a postcard, and an envelop as well as a regular paper generally used for copying purposes. The image forming apparatus 100 is also a duplex image forming apparatus that may perform an image on both sides of a transfer sheet S as a recording material that is a recording body as a paper that is a recording medium.

The image forming apparatus 100 employs a tandem structure, that is, a tandem type in which photoreceptor drums 20Y, 20M, 20C, and 20BK which are latent image carriers as drum types of image carriers that may form images respectively corresponding to colors separated into colors of yellow, magenta, cyan, and black, are disposed in line in a four-series tandem form in a direction that a transfer belt 11 stretches over.

The photoreceptor drums 20Y, 20M, 20C, and 20BK are rotatably supported to a frame (not shown) of a main body 99 that functions as a printer section of the image forming apparatus 100 and disposed in this order from an upstream side of a direction of A1 that is a movement direction of the transfer belt 11 as an intermediate belt that is a transfer body as an intermediate transfer body and a counter clock direction in FIG. 1. Y, M, C, and BK attached behind reference numerals denote members for yellow, magenta, cyan, and black, respectively.

The photoreceptor drums 20Y, 20M, 20C, and 20BK are disposed in image forming units 60Y, 60M, 60C, and 60BK as image-forming devices for forming images of yellow (Y), magenta, (M), cyan (C), and black (BK), respectively.

The photoreceptor drums 20Y, 20M, 20C, and 20BK are positioned on an outer circumferential surface side, i.e., an image forming surface side of the endless transfer belt 11 as an endless belt disposed at substantially a center inside the main body 99.

The transfer belt 11 is movable in a direction of an arrow A1 while confronting the photoreceptor drums 20Y, 20M, 20C, and 20BK. Visible images, i.e., toner images formed on the photoreceptor drums 20Y, 20M, 20C, and 20BK are transferred onto the transfer belt 11 as a transfer medium that moves in the arrow A1 direction in a superimposed manner, and then are bulk transferred onto a transfer sheet S. Thus, the image forming apparatus 100 operates as an image forming apparatus of an intermediate transfer type. Thus, the image forming apparatus 100 operates as an electrophotographic apparatus of a tandem type indirection transfer method.

The underside of the transfer belt 11 faces the photoreceptor drums 20Y, 20M, 20C, and 20BK, and facing positions that are facing sections form a primary transfer section 58 as a primary transferring area that transfers toner images on the photoreceptor drums 20Y, 20M, 20C, and 20BK onto the transfer belt 11.

The toner images formed on the photoreceptor drums 20Y, 20M, 20C, and 20BK is transferred onto the same position of the transfer belt 11 in a superimposed manner while the transfer belt 11 moves in the A1 direction. The superimposed transfer on the transfer belt 11 is performed at transfer positions that are positions of the transfer belt 11 facing the photoreceptor drums 20Y, 20M, 20C, and 20BK by applying a voltage through primary transfer rollers 12Y, 12M, 12C, and 12BK as first rollers disposed at positions facing the photoreceptor drums 20Y, 20M, 20C, and 20BK in which the transfer belt 11 is interposed therebetween at a timing shifted from an upstream side to a downstream side in the A1 direction.

Inside the main body 99, the image forming apparatus 100 includes the image forming units 60Y, 60M, 60C, and 60BK as four image-forming devices, a transfer belt unit 10 that is disposed above the photoreceptor drums 20Y, 20M, 20C, and 20BK and is an intermediate transfer unit of a transfer unit that is an intermediate transfer apparatus including the transfer belt 11, a secondary transfer device 5 disposed to face the transfer belt 11 at the right side of the transfer belt 11 of FIG. 1, and an optical scanning device 8 as an exposure device that is an optical writing device of an optical unit that is an optical writing unit as a latent image forming means disposed below the image forming units 60Y, 60M, 60C, and 60BK.

The image forming apparatus 100 further includes a sheet feeder 61 that is disposed below the optical scanning device inside the main body 99 as a paper feed means as a paper feed device that is a paper cassette of a paper feed unit in which a plurality of transfer sheets S to be conveyed toward a secondary transfer section 57 as a second transfer area between the transfer belt 11 and the secondary transfer device 5 may be stacked, a resist roller pair 4 as a carriage roller that delivers the transfer sheets conveyed from the sheet feeder 61 toward the secondary transfer section 57 at a predetermined timing that is set a timing when the toner image is formed by the image forming units 60Y, 60M, 60C, and 60BK, and a sensor (not shown) that detects that a front end of the transfer sheet S arrives at the resist roller pair 4.

Inside the main body 99, the image forming apparatus 100 further includes a fixing device 6 that is a fixing section as a fixing unit of a roller fixing type for fixing the same toner image onto the transfer sheet S on which the toner image is transferred, an ejecting roller 7 that is an ejecting device as a pair of ejecting rollers that is a discharge roller that discharges the transfer sheet S on which fixing has been performed to the outside of the main body 99, toner bottles 9Y, 9M, 9C, and 9BK that are disposed above the transfer belt unit 10 and have toners of yellow, cyan, magenta, and block colors filled therein, respectively, and a discharge tray 17 which stacks the transfer sheets S discharged to the outside of the main body 99 by the ejecting roller 7 disposed above the main body 99 are stacked and is formed by an in-body discharge section.

The image forming apparatus 100 further includes a duplex unit 51 attached to the right side of the main body 99 in FIG. 1 and a reading device 98 that is positioned above the main body 99 and is an image reader as a scanner for reading a document.

Inside the main body 99, the image forming apparatus 100 further includes a paper conveying path 81 that is formed upward at the right side in FIG. 1, in which the secondary transfer section 57, the resist roller pair 4, the fixing device 6, and the ejecting roller 7 are disposed in the middle thereof, and into which the transfer sheet S delivered from the sheet feeder 61 enters, a feed path 82 that joins the paper conveying path 81 from the duplex unit 51 at an upstream side of the resist roller pair 4 in the conveying direction of the transfer sheet S in the paper conveying path 81, and a re-feed conveying path 83 that is branched toward the duplex unit 51 from the paper conveying path 81 at a downstream side of the fixing device 6 in the conveying direction of the transfer sheet S in the paper conveying path 81.

Figure 2:
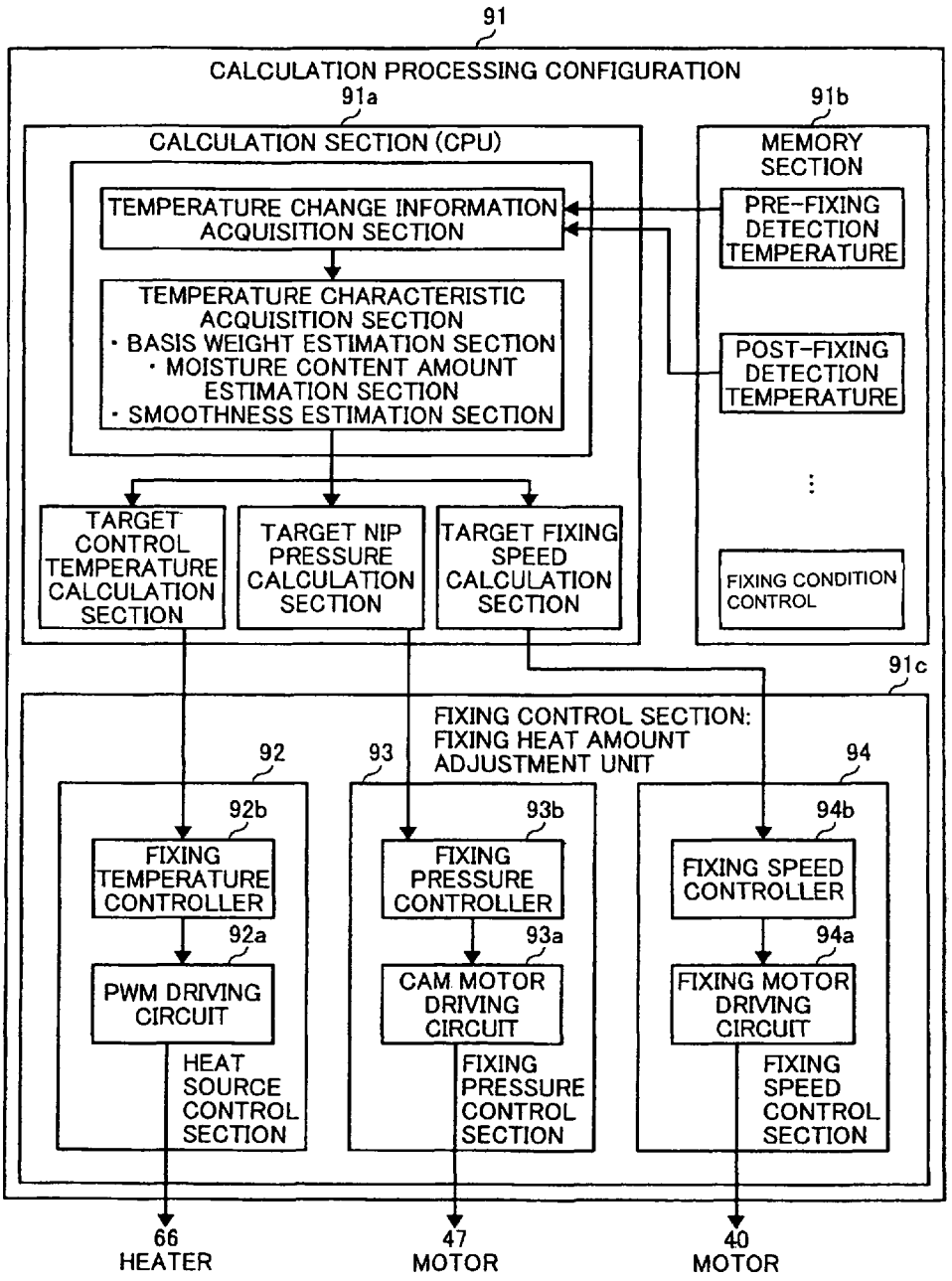
FIG. 2 is a block diagram illustrating a part of a control system that controls the fixing device illustrated in FIG. 1.

Inside the main body 99, the image forming apparatus 100 further includes a drive (not shown) that rotatably drives the photoreceptor drums 20Y, 20M, 20C, and 20BK and a control unit 91 that includes a central processing unit (CPU) 91*a*, as a calculation section illustrated in FIG. 2, that controls the entire operation of the image forming apparatus 100, a memory section 91*b* that is a memory as a storage section of a storage means, and a fixing control section 91*c* of a fixing control means for controlling the fixing device 6.

Inside the main body 99, the image forming apparatus 100 includes a start switch (not shown) for giving an image formation start instruction and an operation panel (not shown) that includes a paper type input key as a paper type input means for inputting the thickness of the transfer sheet S, designates an operation and a working mode of the image forming apparatus 100, and includes a liquid crystal display (LCD) device (not shown) as a display means for performing a predetermined display.

As illustrated in FIG. 1, the image forming apparatus 100 is an image forming apparatus of an in-body discharge type in which the discharge tray 17 is positioned above the main body 99 and below the reading device 98.

The transfer belt unit 10 includes the primary transfer rollers 12Y, 12M, 12C, and 12BK as primary transfer bias rollers, driving rollers 72 that are driving members as a plurality of rollers which the transfer belt 11 is wounded around and stretched over, a cleaning facing roller 74 as a stretching/spanning roller, stretching/spanning rollers 33 and 34 as supporting rollers that stretch and span the transfer belt 11 together with the driving roller 72 and the cleaning facing roller 74, and a tension roller 75 that abuts on the transfer belt 11 from the outside of the transfer belt 11 and applies a predetermined tension to the transfer belt 11 together with the cleaning facing roller 74 in addition to the transfer belt 11.

The transfer belt unit 10 further includes a cleaning device as a belt cleaning device that is an intermediate transfer body cleaning device disposed to face the transfer belt 11 at a position facing the cleaning facing roller 74 that cleans a surface of the transfer belt 11, a driving system (not shown) that rotatably drives the driving roller 72, and a power source as a bias applying means (not shown) and a bias control means, the former applies a primary transfer bias to the primary transfer rollers 12Y, 12M, 12C, and 12BK and constitutes the primary transfer device together with the primary transfer rollers 12Y, 12M, 12C, and 12BK, respectively.

The cleaning facing roller 74, the stretching/spanning rollers 33 and 34, and the tension roller 75 are driven rollers that rotate together with the transfer belt 11 rotatably driven by the driving roller 72. The primary transfer rollers 12Y, 12M, 12C, and 12BK presses a back surface of the transfer belt 11 against the photoreceptor drums 20Y, 20M, 20C, and 20BK to form the primary transfer nips, respectively. The primary transfer nips are formed on parts of the transfer belt 11 nearly horizontally stretched between the cleaning facing roller 74 and the stretching/spanning roller 33. The cleaning facing roller 74, the stretching/spanning roller 33, and the tension roller 75 have a function of stabilizing the primary transfer nips.

In the primary transfer nips, due to influence of the primary transfer bias, an electric filed for primary transfer is formed between the photoreceptor drums 20Y, 20M, 20C, and 20BK and the primary transfer rollers 12Y, 12M, 12C, and 12BK. The toner images of respective colors formed on the photoreceptor drums 20Y, 20M, 20C, and 20BK are primarily transferred onto the transfer belt 11 due to influence of the electric field for primary transfer or nip pressure.

The driving roller 72 abuts on the secondary transfer device 5 through the transfer belt 11 and forms the secondary transfer section 57.

The cleaning facing roller 74 has a function of a tension roller as a pressing member that applies a predetermined tension appropriate for the transfer to the transfer belt 11 together with the tension roller 75.

A cleaning device 13 is disposed at the left lower side of the transfer belt unit 10 in FIG. 1, specifically, below the cleaning facing roller 74. The cleaning device 13 includes a cleaning member (not shown) disposed to abut on the transfer belt 11 at a position facing the cleaning facing roller 74, a case inside which the cleaning member is accommodated, and a waste toner collecting bottle disposed at a front left side of the paper of the case in FIG. 1.

The cleaning device 13 cleans the transfer belt 11 by scraping and removing a foreign substance such as a residual toner on the transfer belt 11 through the cleaning member. The foreign substance removed from the transfer belt 11 is stored in the waste toner collecting bottle. The waste toner collecting bottle may be taken out to the front side of the paper in FIG. 1 in a state in which a front panel is opened and may be replaced with a new one when the inside thereof is full of the foreign substances. Similarly, cleaning devices 71Y, 71M, 71C, and 71BK which will be described later have replaceable waste toner collecting bottles, respectively.

The sheet feeder 61 accommodates a bundle of transfer sheets in which a plurality of transfer sheets S are superimposed and is disposed below the optical scanning device 8 in the lower portion of the main body 99. The sheet feeder 61 includes a plurality of paper cassettes 25 that is superimposed in a vertical direction so that a plurality of transfer sheets S may be accommodated in a state of a bundle of papers (two cassettes are disposed in the present embodiment), a feed roller 24 as a feed roller that abuts on a top surface of the upmost transfer sheet S among the transfer sheets S stacked on each of the paper cassettes 25, a separating roller (not shown) that separates and conveys only one sheet among the transfer sheets S fed by the feed roller 24, and an open/closed detection sensor 26 as a detection means that detects whether the paper cassette 25 is opened or closed on the main body 99. As the feed roller 24 rotatably rotates in counter clock direction at a predetermined timing, the sheet feeder 61 feeds the upmost transfer sheet S toward the resist roller pair 4.

The sheet feed device 23 is selectively driven rotatable in counter clock direction in FIG. 1. As the separating roller operates, the upmost transfer sheet S among the transfer sheets S stacked on the paper cassette 25 enters the paper conveying path 81 and is fed toward the resist roller pair 4. The conveyed transfer sheet S abuts on and stops in a state in which it is interposed between the rollers of the resist roller pair 4.

The secondary transfer device 5 is disposed facing the driving roller 72. The secondary transfer device 5 includes a secondary transfer roller (not shown) that is a transfer member disposed to interpose the transfer belt between the secondary transfer roller and the driving roller 72. The secondary transfer device 5 further includes a conveying function for conveying the transfer sheet S onto which the toner image has been transferred to the fixing device 6 through the secondary transfer roller.

The duplex unit 51 includes a manual feeding device 53 disposed on a lateral surface, a part of the feed path 82 disposed to cross the inside of the duplex unit 51 from the manual feeding device 53, a reverse conveying path 21 through which the transfer sheet S that has passed through the re-feed conveying path 83 is reversed and conveyed toward the feed path 82, and a conveying roller 23 that conveys the transfer sheet S disposed in the reverse conveying path 21 toward the feed path 82.

The manual feeding device 53 includes a bypass tray 27 as a manual feed tray on which the transfer sheet S may be stacked, a feed roller 28 which abuts on the top surface of the upmost transfer sheet among the transfer sheets S stacked on the bypass tray 27, and a separating roller (not shown) that separates the transfer sheet delivered by the feed roller 28 one by one.

In the manual feeding device 53, as the feed roller 28 is rotatably driven clockwise in FIG. 1, the separating roller operates, and the upmost transfer sheet S is fed toward the resist roller pair 4. The conveyed transfer sheet S abuts on and stops in a state in which it is interposed between the rollers of the resist roller pair 4.

The fixing device 6 includes a fixing roller 65 as a roller-like fixing member, a pressing roller 63 as a roller-like pressing member in order to form a fixing nip 62 as a fixing section that is a press-contact section that comes in press-contact with the fixing roller 65 to press the transfer sheet S, a heater 66 that is a halogen heater as a heat generating means that is a fixing heat source that is a heat source as a heating means that is disposed inside the fixing roller 65 and heats the fixing the fixing roller 65 and heats the fixing nip 62 at a predetermined temperature, and a non-contact type thermistor 68 as a temperature detection means that is a fixing member temperature detection section that is disposed adjacent to an outer circumferential surface of the fixing roller 65 and detects the temperature of the fixing roller 65.

As the heat source, a heat source such as a ceramic heater, a carbon heater, or induction heating as well as the halogen heater may be used.

As the temperature detection means, a non-contact type sensor such as a thermopile or an NC sensor or a contact type thermistor may be used, but the temperature detection means having high responsiveness is preferable.

Figure 3:
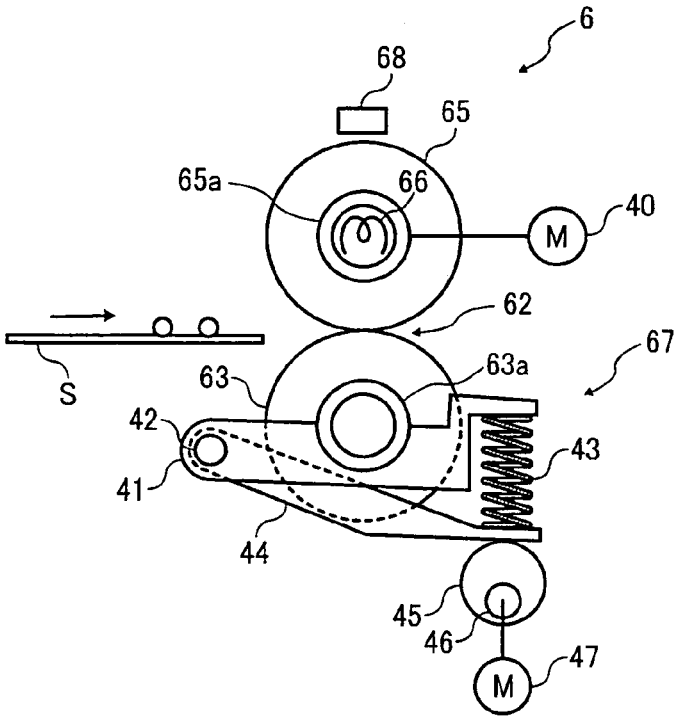
FIG. 3 is a schematic front view illustrating a configuration for urging a pressing member disposed in the fixing device illustrated in FIG. 1 to a fixing member with a predetermined strength.

The fixing device 6 includes a nip forming unit 67 that makes the pressing roller 63 come in press-contact with the fixing roller 65 to form the fixing nip 62, a motor 40 that is a fixing motor which is a fixing speed driving means of a driving means that conveys the transfer sheet S that has entered the fixing nip 62 by rotatably driving the fixing roller 65 and thus rotating the pressing roller 63 by the fixing roller 65, and a housing (not shown) that includes other members and means that constitute the fixing device 6 as illustrated in FIG. 3.

Figure 4:
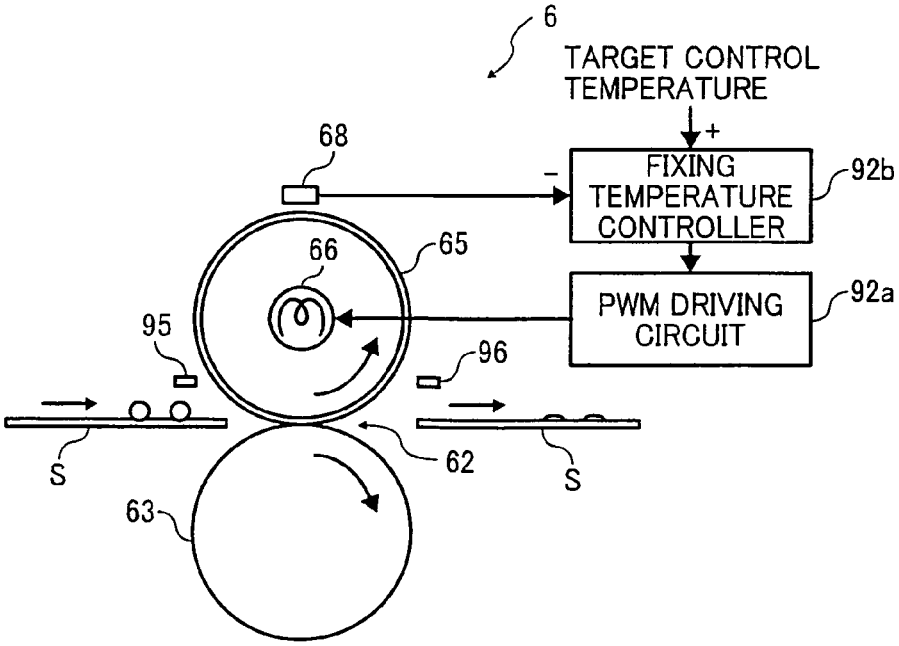
FIG. 4 is a schematic diagram illustrating a configuration for controlling the temperature of a fixing nip of the fixing device illustrated in FIG. 1.

As illustrated in FIG. 4, the fixing device 6 includes a pulse width modulation (PWM) driving circuit 92*a* as a heating driving means that drives the heater 66 and a fixing temperature controller 92*b* of a temperature controller that is a fixing temperature control means of a heating driving control means that controls the temperature of the fixing roller 65 by controlling power applied to the heater 66 through a power supply time (=DUTY) per unit time through the PWM driving circuit 92*a* based on information of a designated target control temperature of the fixing roller 65 and a temperature deviation from a temperature of the fixing roller 65 detected by the thermistor 68.

As illustrated in FIG. 2, the PWM driving circuit 92*a* and the fixing temperature controller 92*b* are disposed in a heat source control section of a heat source control means disposed in the control unit 91 that functions as the fixing control section 91*c*. A heat source control section 92 controls the temperature of the fixing nip 62 substantially by controlling the temperature of the fixing roller 65.

As illustrated in FIG. 3, the nip forming unit 67 includes a pressing member 41 as a pressurizing/pressing member that presses and urges an support shaft 41 abutting to the shaft 63*a* that is a rotating shaft of the pressing roller 63, a shaft 42 that rotatably supports one end of the pressing member 41 to a housing, a spring 43 that is a pressurizing/pressing spring as an urging member that has one end abutting on the other end of the pressing member 41 and applies pressure to the shaft 63*a* through the pressing member 41, an arm 44 that is an urging support member that has one end abutting on the other end of the spring 43 and the other end rotatably supported to the shaft 42 in a state in which the spring 43 is interposed between the arm 44 and the pressing member 41, a cam 45 as an eccentric cam that abuts on one end side of the arm 44 from the opposite side of the spring 43, and a motor 47 as a cam motor that is a stepping motor that is a fixing pressure driving means of a driving means that has a shaft 46 that is a rotating shaft for rotatably driving the cam 45 as an output shaft. In FIG. 3, a reference numeral 65*a* denotes a shaft that is a rotating shaft of the fixing roller 65.

In the nip forming unit 67 having the above configuration, a rotation angle of the cam 45 and pressure in the fixing nip have a one-to-one correspondence relationship. Thus, by changing pressurizing/pressing force by driving the motor 47 to control the rotation angle of the shaft 46 and rotatably driving the cam 45 to control an amount of compression of the spring 43, force that the pressing roller 63 comes in press-contact with the fixing roller 65, that is, pressure of the fixing nip 62 may be controlled.

Driving control of the motor 47 is performed by the control unit 91. For this reason, as illustrated in FIG. 2, the control unit 91 functions as a fixing pressure control section 93 as the fixing pressure control means for controlling fixing pressure that is nip pressure that is pressure between the fixing roller 65 and the pressing roller 63 in the fixing nip 62. The fixing pressure control section 93 includes a cam motor driving circuit 93*a* for driving the motor 47 and a fixing pressure controller 93*b* as a pressure controller that is a fixing pressure control means of a fixing pressure driving control means that generates a pulse for driving the motor 47 in the cam motor driving circuit 93*a* and controls a rotation angle of the shaft 46, that is, a rotation angle of the cam 45 so that the fixing pressure may become designated pressure.

Driving control of the motor 40 is performed by the control unit 91. As illustrated in FIG. 2, the control unit 91 functions as a fixing speed control section 94 in the fixing control section 91*c* that is a fixing time control means as a fixing speed control means that controls a fixing speed in the fixing nip 62, i.e., a conveying speed for conveying the transfer sheet S in the fixing nip 62, i.e., a transit time that is a passing time of the transfer sheet S in the fixing nip 62, and a fixing speed. The fixing speed control section 94 includes a fixing motor driving circuit 94*a* for driving the motor 40 and a fixing speed controller 94*b* as a speed controller that is a fixing speed control means as a fixing speed driving control means that generates a signal for controlling the rotation speed of the motor 40 in the fixing motor driving circuit 94*a* so that the fixing time and the fixing speed may become the designated time and speed.

In the fixing device 6, the transfer sheet S on which the toner image is carried is passed in a state in which the transfer sheet S is interposed in the fixing nip 62, and the fixing roller 65 comes in contact with an image surface of the transfer sheet S on which the toner image is carried. As a result, due to an action of heat and pressure, the toner that constitutes the carried toner image is melted, pressure-fixed, and fixed to the surface of the transfer sheet S.

In the present embodiment, the shaft 63*a* of the shaft 65*a* of the fixing roller 65 and the shaft 63*a* of the pressing roller 63 is rotatably and movably supported to the housing, and the shaft 65*a* is rotatably supported to the housing at a fixed position. Further, the pressing roller 63 is contactable to or separatable from the fixing roller 65, and the pressing roller 63 comes in press-contact with the fixing roller 65 through the nip forming unit 67. However, the shaft 65*a* of the shaft 65*a* and the shaft 63*a* may be rotatably and movably supported to the housing, the shaft 63*a* may be rotatably supported to the housing at a fixed position. Further, the fixing roller 65 may be contactable to or separatable from the pressing roller 63, and the fixing roller 65 may come in press-contact with the pressing roller 63 through the nip forming unit 67.

The other components of the fixing device 6 will be described later.

The toners of yellow, cyan, magenta, and black colors inside the toner bottles 9Y, 9M, 9C, and 9BK are polymeric toners and which is rotated by a driving means (not shown) to discharge the toners. A predetermined supply amount of toner is supplied to developing devices 80Y, 80M, 80C, and 80BK disposed in the image forming units 60Y, 60M, 60C, and 60BK which will be described later through the conveying path configured with a pipe and the like (not shown).

Even though not shown in detail, the reading device 98 includes a contact glass on which a document is placed, a first traveling body that includes a light source that irradiates light to the document placed on the contact glass, and a first reflector that reflects light that is irradiated from the light source to the document and reflected and travels in a left-right direction in FIG. 1, a second traveling body that includes a second reflector that reflects light reflected by the reflector of the first traveling body, an imaging lens for imaging light from the second traveling body, and a reading sensor that receives light that passed through the imaging lens and reads a content of the document.

The image forming units 60Y, 60M, 60C, and 60BK have the same configuration as each other. The image forming units 60Y, 60M, 60C, and 60BK includes the primary transfer rollers 12Y, 12M, 12C, and 12BK as process means disposed around the photoreceptor drums 20Y, 20M, 20C, and 20BK in a rotation direction B1 that is a clock direction in FIG. 1, cleaning devices as cleaning means, a static eliminator (not shown) as a static eliminating means, charging devices 79Y, 79M, 79C, and 79BK as charging means for performing alternating current (AC) charging, and the developing devices 80Y, 80M, 80C, and 80BK as developing means performing development using a two-component developer, respectively.

The photoreceptor drum 20Y, the cleaning device 71Y, the static eliminator, the charging device 79Y, and the developing device 80Y constitute a process cartridge in an integrated manner. The components around the photoreceptor drums 20M, 20C, and 20BK also constitute processes cartridges in an integrated manner. The process cartridges are attachable and removable in a rotating axis direction of the photoreceptor drums 20Y, 20M, 20C, and 20BK that is a front side in FIG. 1 in a state in which the front panel is opened. The process cartridges are preferable because they may be treated as replacement parts, and maintainability may be remarkably improved.

In the image forming apparatus 100 having the above configuration, when the start switch is pressed down, a next image forming process in each of the image forming units 60Y, 60M, 60C, and 60BK is executed, so that image formation is performed. That is, when a signal representing that a color image should be formed is input, the reading device 98 reads the document to acquire data corresponding to an image to form. Further, as the driving roller 72 is driven, the transfer belt 11, the cleaning facing roller 74, the stretching/spanning rollers 33 and 34, and the tension roller 75 are thus followed to be rotated, and the photoreceptor drums 20Y, 20M, 20C, and 20BK are rotatably driven in the B1 direction.

As the photoreceptor drums 20Y, 20M, 20C, and 20BK rotate in the B1 direction, the surfaces of the photoreceptor drums 20Y, 20M, 20C, and 20BK are uniformly charged by the charging devices 79Y, 79M, 79C, and 79BK. Electrostatic latent images corresponding to respective colors of yellow, magenta, cyan, and black are formed by exposure scanning of laser light from the optical scanning device 8 driven by the control means based on the data corresponding to the image to form. The electrostatic latent images are developed by toners of respective colors of yellow, magenta, cyan, and black through the developing devices 80Y, 80M, 80C, and 80BK and visualized, so that monochromatic images constituted by toner images of respective colors of yellow, magenta, cyan, and black are formed.

The toner images of respective colors of yellow, magenta, cyan, and black obtained by the development are sequentially transferred in a superimposed manner onto the same position on the transfer belt 11 that rotates in the A1 direction through the primary transfer rollers 12Y, 12M, 12C, and 12BK, so that a composite color image is formed on the transfer belt 11.

Meanwhile, when a signal representing that a color image should be formed is input, any one of the feed roller 24 correspondingly to each paper cassette and the feed roller 28 correspondingly to the bypass tray 27 is selected and rotatably driven to deliver the transfer sheet S and separates and convey the transfer sheet S one by one. The conveyed transfer sheet S stops in a state in which it abuts on the resist roller pair 4. In the case of duplex image formation, the transfer sheet S that the image is fixed on one side thereof in the fixing device 6 as will be described later stops in a state in which the front and the back are reversed through the reverse conveying path 21 and the transfer sheet abuts on the resist roller pair 4.

In synchronization with a timing when the composite color image superimposed on the transfer belt 11 moves to the secondary transfer section 57 by rotation of the A1 direction of the transfer belt 11, the resist roller pair 4 rotates. In the secondary transfer section 57, the composite color image comes in close contact with the transfer sheet S fed to the secondary transfer section 57 and is secondary transferred and recorded onto the transfer sheet S by an effect of the nip pressure.

The transfer sheet S is conveyed and fed to the fixing device 6 by the secondary transfer device 5 and the transfer belt 11 that rotates in the A1 direction. When passing through the fixing nip 62 between the fixing roller 65 and the pressing roller 63 in the fixing device 6 that is the fixing section, the carried toner image, that is, the composite color image is fixed onto the transfer sheet S by the effect of heat and pressure.

The transfer sheet S on which the composite color image has been fixed through the fixing device 6 is discharged to the outside of the main body through the ejecting roller 7 and stacked on the discharge tray 17 in the upper portion of the main body 99. In the duplex image formation, the transfer sheet S that fixing has been performed on one side thereof is conveyed toward the resist roller pair 4 again through the re-feed conveying path 83 and the reverse conveying path 21.

The toners after transfer remaining on the photoreceptor drums 20Y, 20M, 20C, and 20BK are removed by the cleaning devices 71Y, 71M, 71C, and 71BK, statically eliminated by the static eliminator, and subjected to next charging by the charging devices 79Y, 79M, 79C, and 79BK.

The surface of the transfer belt 11 that has passed through the secondary transfer section 57 that has finished the secondary transfer is cleaned by the cleaning member disposed in the cleaning device 13 and prepared for the next transfer.

Here, as described above, in the fixing device that performs fixing by passing the transfer sheet S on which the toner image is carried through the fixing nip 62, it is very important to appropriately provide the transfer sheet S or the toner image with the heat amount necessary for fixing the toner image onto the transfer sheet S in the fixing nip 62 for the purpose of preventing or suppressing the cold offset, the hot offset, and unnecessary power consumption.

Therefore, it is necessary to grasp the heat amount appropriate for fixing and perform control so that the heat amount provided to the transfer sheet S in the fixing nip 62 may become the appropriate heat amount.

The input heat necessary for fixing depends on a temperature rise characteristic as a feature quantity that is a temperature rising characteristic when the transfer sheet S receives heat in the fixing nip 62. The temperature rise characteristic may be also expressed as a degree of temperature rise or a degree of heat acquisition and depends on a heat capacity or thermal absorbability of the transfer sheet S.

Figure 15:
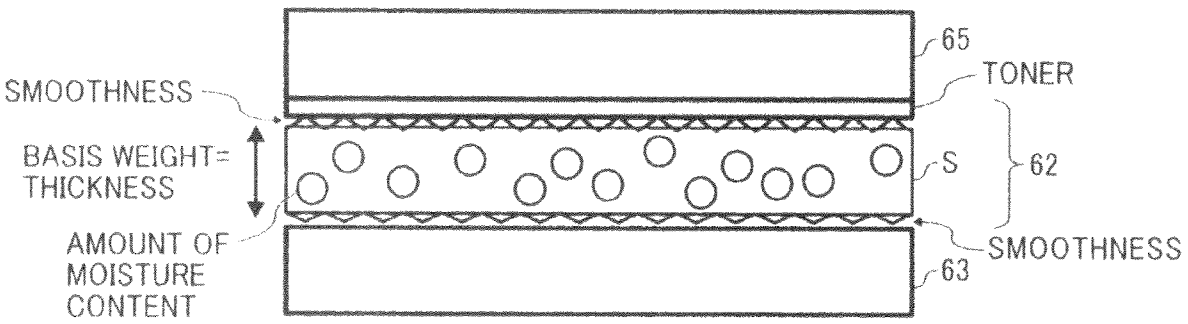
FIG. 15 is a concept diagram for illustrating that a temperature rise characteristic of a recording medium is decided by a basis weight, an amount of moisture content, and smoothness of the recording medium.

FIG. 15 schematically illustrates a parameter related to the heat capacity and the thermal absorbability of the transfer sheet S that influence the temperature rise characteristic.

The heat capacity is dependent on the basis weight or the amount of moisture content of the transfer sheet S, and the thermal absorbability is dependent on the smoothness of the transfer sheet S.

Figure 16:
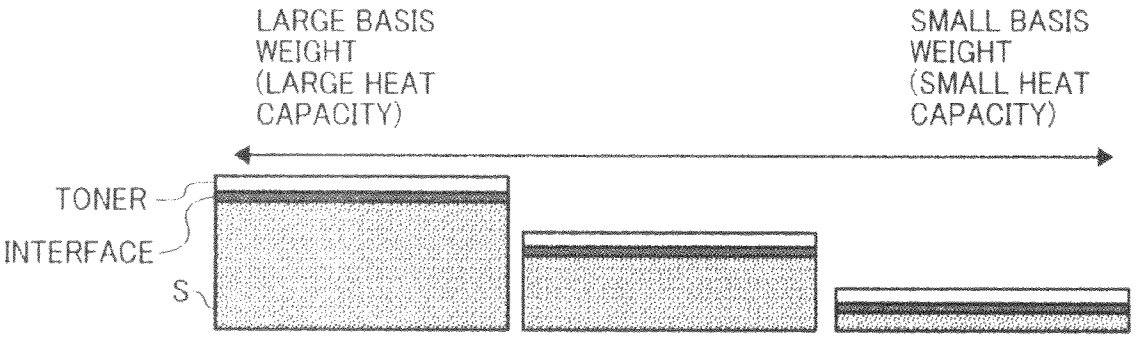
FIG. 16 is a concept diagram for illustrating that a temperature rise characteristic of a recording medium is decided by a basis weight of the recording medium.

The basis weight refers to a weight per unit area and depends on the thickness and the density of the transfer sheet S. As the thickness and the density of the transfer sheet S increases, the basis weight increases, and the heat capacity increases. Therefore, as illustrated in FIG. 16, when heat is provided from the fixing roller 65 as in the present embodiment or when heat is provided from the pressing roller 63 alternatively or additionally, if a heat amount provided is identical, as the heat capacity increases, the temperature of the interface between the toner and the transfer sheet S relatively becomes lower, and fixing force, that is, the adhesion strength between the toner and the transfer sheet S similarly decreases. Thus, in order to make the fixing force uniform, to the extent that the basis weight increases, the input heat necessary for fixing needs increase.

Figure 17:
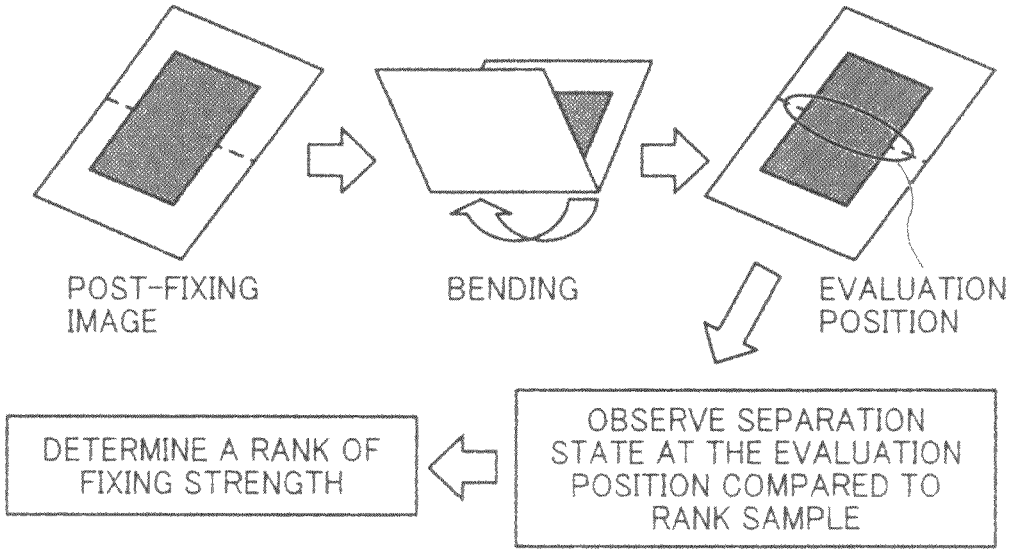
FIG. 17 is a schematic diagram illustrating a fixing-strength-rank evaluation method by bending.

For a fixing strength, a method is used in which the fixing strength is evaluated by the degree of separation of tonner from a sheet when the sheet is bent and a separation state is ranked. An evaluation procedure is shown in FIG. 17 below.

Figure 18:
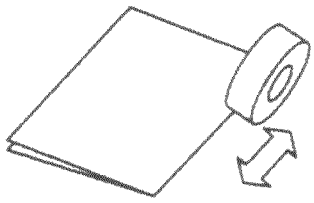
FIG. 18 is a schematic diagram illustrating a folding method by a weight.

A recording medium after fixing is slightly bent so that a tonner surface faces inward, and the recording medium is creased by using a given weight. Here, as shown in FIG. 18 below, the recording medium is creased by moving a cylindrical weight with a width of 50 mm and a weight of 1 kg on a bent part while rotating to make a round trip between the ends of the bent part.

Figure 19:
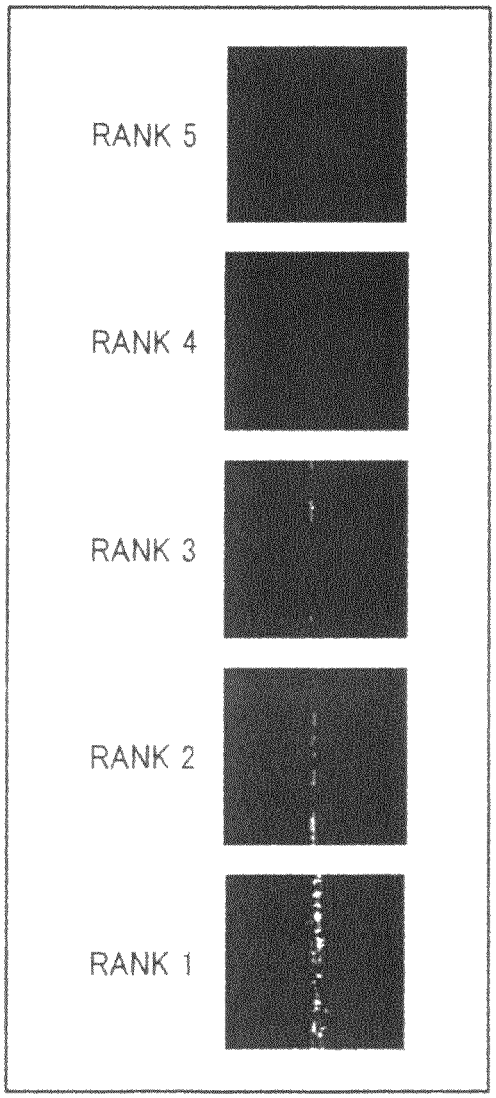
FIG. 19 is a schematic diagram illustrating a fixing strength classification sample.

Subsequently, the sheet is opened, an evaluation position is lightly rubbed by a rag and separated tonner is removed from the sheet. The fixing strength is evaluated by ranking the toner separation state at the evaluation position using a classification sample of five grades. The classification sample is as shown in FIG. 19, with which it is possible to classify from rank 1 in which tonner is separated over the entire area to rank 5 in which there is no separation of toner.

The amount of moisture content refers to the amount of moisture content in the transfer sheet S. As the amount of moisture content increases, the moisture evaporated when the fixing nip 62 receives heat increases. Since the received heat is deprived of as vaporization heat, when the moisture in the transfer sheet S evaporates, the amount of heat deprived of the transfer sheet S increases. Thus, when the same heat amount is applied, as the amount of moisture content increases, the temperature of the interface between the toner and the transfer sheet S becomes lower. Thus, in order to make the fixing force uniform, to the extent that the amount of moisture content increases, the input heat necessary for fixing needs increase. Since the basis weight is not taken into consideration for a weight change of the transfer sheet S caused by the amount of moisture content of the transfer sheet, the amount of moisture content is also a parameter that influences the heat capacity.

The smoothness refers to one which decides a contact state of the transfer sheet S on the fixing roller 65 or the pressing roller 63. To the extent that the smoothness of the transfer sheet S is low and the surface is coarse, that is, as the surface is rough, a contact area with the fixing roller 65 and the like decreases, and the heat amount received by the fixing nip 62 decreases. Thus, when the same heat amount is applied, as the smoothness is low, the input heat necessary for satisfying the fixing force needs increase.

It has been known that the basis weight particularly among the parameters is very responsive to setting of the input heat. Thus, in the present embodiment, a description will be made focusing on the basis weight as the parameter that influences the temperature rise characteristic of the transfer sheet S. Further, as another parameter, there is a toner adhesion amount. As the toner adhesion amount increases, since the heat capacity increases, the input heat quantity needs increase. However, the influence that the toner adhesion amount has on the temperature rise characteristic is lower compared to the other parameters such as the basis weight. Thus, here the toner adhesion amount is not treated as the parameter that influences the temperature rise characteristic.

In the case in which the temperature rise characteristic of the transfer sheet S is estimated based on the basis weight, if the basis weight is acquired based on the paper type input by the user, for example, whether the transfer sheet S is a thick paper or a regular paper, when the user erroneously recognizes the paper type, the temperature rise characteristic is estimated differently from an actual one. Generally, in the case of a popular model typically used in the office, the paper type that may be input by the user is broad as a paper classification such as a thin paper, a regular paper, and a thick paper. Thus, even if the user does not misunderstand the paper type, the accurate basis weight may not be acquired. It may be considered to estimate the paper type based on the temperature change of the member that is disposed in the fixing device 6 to form the fixing nip 62 and contacts the transfer sheet S like the fixing roller 65. However, in this case, the temperature change may be caused due to disturbance such as absorption of heat by the transfer sheet S or absorption of heat by the axles 65*a* and 63*a* or the member that contacts them. Thus, it is not sufficient to extract only the temperature rise characteristic of the transfer sheet S based on the basis weight, and a possibility that a degree of accuracy with which the basis weight is acquired will be lowered is high.

Thus, in the fixing device 6 and the image forming apparatus 100, the temperature rise characteristic of the transfer sheet S is acquired based on the temperature change of the transfer sheet S itself, and control is performed so that the heat quantity to be provided to the transfer sheet S in the fixing nip may become the appropriate heat amount.

Here, control of the heat amount to be provided to the transfer sheet S in the fixing nip 62 is performed by adjusting at least one of the temperature of the fixing nip 62, the pressure of the fixing nip 62, and the transit time of the transfer sheet S in the fixing nip 62. However, for convenience of description, as illustrated in FIG. 2, the control unit 91 include the heat source control section 92, the fixing pressure control section 93, and the fixing speed control section 94 in the fixing control section 91*c* that correspond to the temperature, the pressure, and the transit time, respectively.

In order to detect the temperature change of the transfer sheet S itself, as illustrated in FIG. 4, the fixing device 6 includes a sensor 95 that is a pre-fixing paper temperature sensor and a sensor 96 that is a post-fixing temperature sensor as a temperature detection means that measures and detects the temperature of the transfer sheet ahead of and behind the fixing nip 62 in the conveying direction of the transfer sheet S. Both the sensors 95 and 96 are radiation type temperature sensors that measure the temperature of the transfer sheet S in a non-contact manner.

The temperatures of the transfer sheet S detected by the sensors 95 and 96 are stored in the memory section 91*b* of the control unit 91, and the CPU 91*a* of the control unit 91 acquires temperature change information of the transfer sheet S based on the stored temperatures. Specifically, the temperature change information is acquired by subtracting the temperature of the transfer sheet S detected by the sensor 95 before passing through the transfer nip 62, that is, before the temperature rises from the temperature of the transfer sheet S, detected by the sensor 96, that has passed through the transfer nip 62 and so has risen in temperature. In this regard, the memory section 91*b* functions as a detection temperature storage means. Particularly, the memory section 91*b* that functions as the detection temperature storage means functions as a pre-fixing detection temperature storage means related to the storage of the temperature detected by the sensor 95 and functions as a post-fixing detection temperature storage means related to the storage of the temperature detected by the sensor 96. The CPU 91*a* functions as a temperature change information acquisition section of a temperature change information acquisition means.

Subsequently, based on the temperature change information acquired by the CPU 91*a* that functions as the temperature change information acquisition section, that is, the paper temperature change information before and after the fixing nip 62, the CPU 91*a* extracts, specifies, and acquires the temperature rise characteristic of the transfer sheet S. In this regard, the CPU 91*a* functions as a temperature rise characteristic acquisition section as a temperature rise characteristic acquisition means.

Acquisition, that is, estimation of the temperature rise characteristic by the CPU 91*a* that functions as the temperature characteristic acquisition section is performed as follows.

That is, the temperature change information is measured and calculated. The basis weight of the transfer sheet S is estimated, and a target control temperature for the estimated basis weight is set and the temperature of the fixing roller 65 is controlled so as to become the target control temperature through detection of the temperature of the fixing roller 65 by thermistor 68, the heat amount to be provided to the transfer sheet S in the fixing nip 62 is appropriately adjusted, thereby constant fixing force is obtained regardless of the basis weight of the transfer sheet S.

The reasons will be described below.

Figure 5:
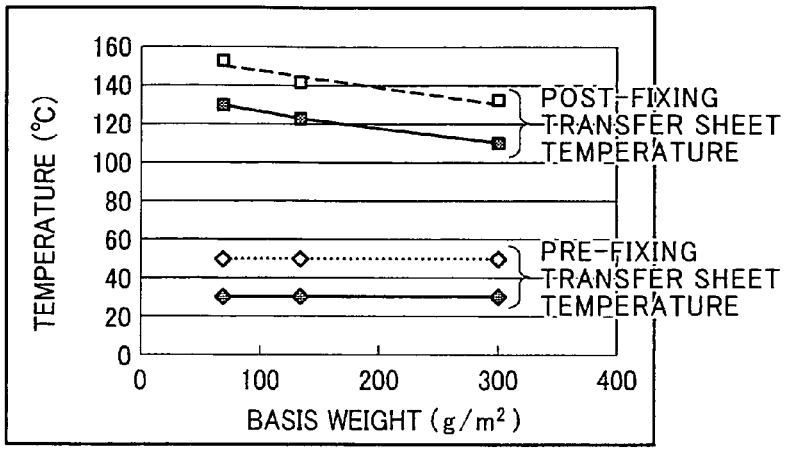
FIG. 5 is a graph illustrating a correlation between a basis weight of a recording medium and a temperature before and after fixing.

FIG. 5 illustrates a correlation of the temperature of the transfer sheets before and after passing through the fixing nip 62 when the temperature of the fixing roller 65 is controlled to a certain temperature.

As can be seen in FIG. 5, when the temperature of the transfer sheet S before passing through the fixing nip 62 is the same, to the extent that the basis weight of the transfer sheet S increases, the temperature of the transfer sheet S after passing through the fixing nip 62 is lower. Further, to the extent that the temperature of the transfer sheet S before passing through the fixing nip 62 increases, the temperature of the transfer sheet S after passing through the fixing nip 62 is higher.

Figure 6:
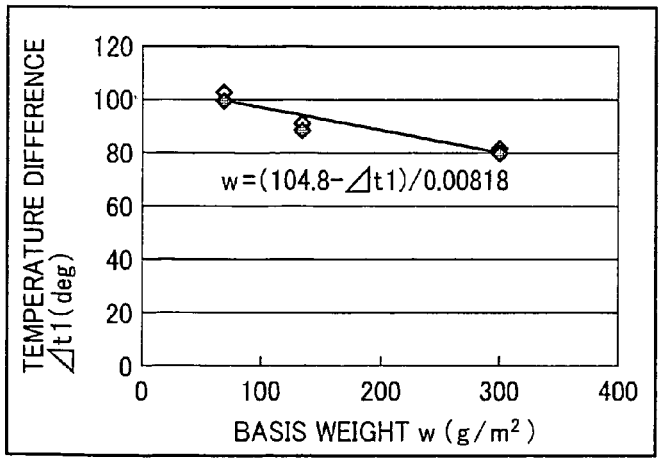
FIG. 6 is a graph illustrating a correlation between a basis weight of a recording medium and a temperature difference between before and after fixing.

FIG. 6 illustrates a correlation between a temperature difference Δt1 of the transfer sheet S before and after passing through the fixing nip 62 and the basis weight w of the transfer sheet S. The temperature difference Δt1 corresponds to the temperature change information calculated by the CPU 91*a* that functions as the temperature change information acquisition section.

As can be seen in FIG. 6, the relation between the temperature difference Δt1 and the basis weight w has a linear relation, and a relational formula obtained by an experiment is as follows:

$$w=(104.8-\Delta t1)/0.0818$$

That is, the relation between the temperature difference Δt1 and the basis weight w is obtained by an experiment as a mathematical formula in advance. Thus, the basis weight w can be estimated by measuring the temperature difference Δt1.

Figure 7:
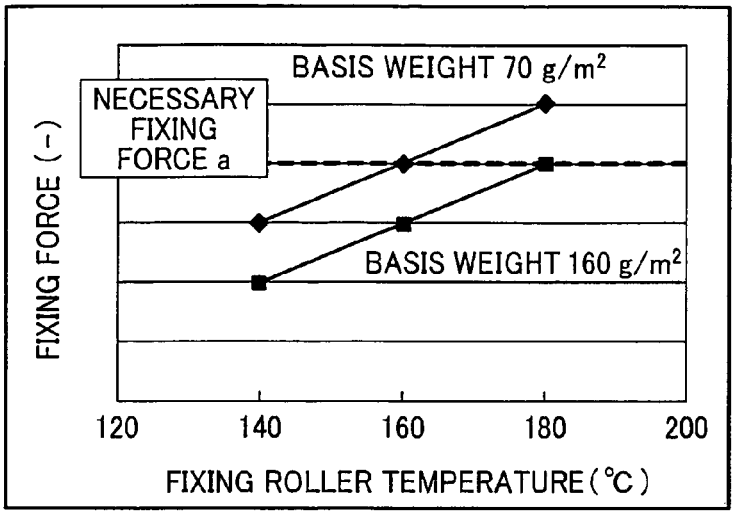
FIG. 7 is a graph illustrating a correlation between a temperature of a fixing nip and fixing force.

FIG. 7 illustrates a correlation between the temperature of the fixing roller 65 and the fixing force. Generally, as illustrated in FIG. 7, as the temperature of the fixing roller 65 increases or as the temperature of the fixing nip 62 increases, the fixing force increases. Generally, in order to obtain the same fixing force, as the basis weight increases, the temperature of the fixing roller 65 needs increase.

Specifically, in FIG. 7, for example, in order to obtain the same fixing force "a" indicated by a dotted line in FIG. 7, in the transfer sheet S of the basis weight of 70 g/m$^2$, the temperature of the fixing roller 65 is as enough as 160° C., whereas in the transfer sheet S of the basis weight of 160 g/m$^2$, the temperature of the fixing roller 65 needs be 180° C.

Due to the above described reasons, the temperature difference Δt1 is measured and calculated. The basis weight of the transfer sheet S is estimated, and the target control temperature of the fixing roller 65 is set according to the estimated basis weight. The temperature of the fixing roller 65 is detected by the thermistor 68, and controlled so as to become the target control temperature. As a result, the constant fixing force is obtained regardless of the basis weight of the transfer sheet S. Accordingly, the cold offset, the hot offset, and unnecessarily power consumption may be prevented or suppressed.

The flow described above is illustrated in FIG. 8.

As described above, when the image formation start instruction is given by pressing the start switch down, and so a image formation request is received from the user (S1), the toner image is transferred onto the transfer sheet S delivered from the paper cassette 25 and the bypass tray 27 in the secondary transfer section 57 and then conveyed toward the fixing device 6.

When the transfer sheet S on which the toner image is transferred and carried reaches at a position facing the sensor 95, temperature detection is performed by the sensor 95 at a position ahead of the fixing nip 62 (S2). A pre-fixing temperature that is the temperature of the transfer sheet S detected by the sensor 95 is stored in the memory section 91*b* that functions as the pre-fixing detection temperature storage means.

The transfer sheet S on which the temperature detection has been performed by the sensor 95 passes through the transfer nip 62 (S3) and reaches at a position facing the sensor 96. At this time, temperature detection is performed by the sensor 96 at a position behind the fixing nip 62 (S4). A post-fixing temperature that is the temperature of the transfer sheet S detected by the sensor 96 is stored in the memory section 91*b* that functions as the post-fixing detection temperature storage means.

When the post-fixing temperature is stored in the memory section 91*b* that functions as the post-fixing detection temperature storage means, by the CPU 91*a* as the temperature change information acquisition section the pre-fixing temperature and the post-fixing temperature from the memory section 91*b* that functions as the detection temperature storage means is read. From their difference, by the CPU 91*a* that functions as the temperature change information acquisition section the temperature difference Δt1 that is the temperature change information is calculated. In conjunction with this, in the CPU 91*a* that functions as the rise of temperature characteristic acquisition section the basis weight of the transfer sheet S is estimated with reference to the relation between the temperature difference Δt1 and the basis weight w (S5). In this regard, the CPU 91*a* that functions as the temperature rise characteristic acquisition section functions as, particularly, a basis weight estimation section.

Based on the basis weight estimated by the CPU 91*a* that functions as the basis weight estimation section, the target control temperature is calculated by CPU 91*a* (S6). In this regard, the CPU 91*a* functions as a target control temperature calculation section of a target control temperature calculation means.

Using the target control temperature calculated by the CPU 91*a* that functions as the target control temperature calculation section, in the fixing control section 91*c* of the control unit 91, power that the heat source control section 92 applies to the heater 66 is controlled (S7). As a result, the appropriate heat amount is provided to the next transfer sheet S that passes through the fixing nip 62, and thus the cold offset, the hot offset, and unnecessary power consumption is prevented or suppressed.

When setting of the target control temperature based on the temperature change information is not set before image formation is performed on the transfer sheet S, the target control temperature on the transfer sheet S on which the temperature change information has been acquired is set based on the paper type input through the operation panel. In this case, setting of the target control temperature performed based on the temperature change information is performed as correction of the basis weight estimated based on the input paper type.

Estimation of the basis weight and setting of the target control temperature based on the temperature change information may be performed each time image formation is performed on one piece of transfer sheet S, each time image formation is performed on multiple pieces of transfer sheets S, or at any other timing. However, if a case in which a large amount of image formation is performed at once like a production printing market is assumed, it is difficult to assume that a type of used transfer sheet S frequently changes.

For this reason, it is more effective to perform estimation of the basis weight and setting of the target control temperature based on the temperature change information only when there is a high possibility that a type of transfer sheet S will change in order to alleviate a load of the CPU 91*a* at the time of a target control temperature setting operation.

Specifically, estimation of the basis weight and setting of the target control temperature based on the temperature change information may be performed only directly after the sheet feed device 61 is opened or closed. As described above, the sheet feed device 61 includes an open/closed detection sensor that detects that the paper cassette 25 is opened or closed. Generally, the open/closed detection sensor is installed to detect an open/closed state of the paper cassette 25 in order to prevent a malfunction.

In a structure of the open/closed detection sensor, when the paper cassette 25 is inserted into the main body 99, power is supplied through a drawer, and a flag representing that power has been supplied is set, for example, like a flag 1. If the paper cassette 25 is taken out of the main body 99, a flag representing that power is disconnected is set, for example, like a flag 0.

Thus, if the flag changes from 1 to 0 and changes from 0 to 1, a state in which the transfer sheet S placed on the paper cassette 25 becomes replaceable is detected. Thus, when the state is detected, that is, at the time of the image formation operation directly after the state is detected, estimation of the basis weight and setting of the target control temperature based on the temperature change information are preferably performed.

Estimation of the basis weight and setting of the target control temperature based on the temperature change information may be performed using the fact that the image forming apparatus 100 includes the duplex unit 51, such that the transfer sheet S that has passed through the fixing nip 62 passes through the fixing nip 62 again and is subjected to fixing, and the temperature change information is acquired when passing the fixing nip 62 first time. This is because after the image formation is performed on a first transfer sheet S and estimation of the basis weight and setting of the target control temperature based on the temperature change information are performed, if fixing is performed at the set appropriate target control temperature when the image formation is performed on a second transfer sheet S, a fixing condition on the first transfer sheet S is not necessarily optimum.

In the case of including the duplex unit 51, at the time of the image formation on a first surface, the transfer sheet S passes in a blank sheet state without transferring the toner image onto the transfer sheet S, and estimation of the basis weight and setting of the target control temperature based on the temperature change information are performed. Then, a typical image formation operation is performed on a second surface. In this case, the cold offset and the hot offset are prevented or suppressed starting from the first sheet, so that the fixation property is stabilized, and unnecessary power consumption is prevented or suppressed. As a result, the occurrence of the fixing failure on the first sheet of the image formation is prevented or suppressed, and unnecessary image formation is prevented or suppressed. If this control is performed only when setting of the target control temperature based on the temperature change information is not performed before the image formation is performed on the transfer sheet S, it is possible to prevent an image formation time from increasing due to twice passes of the fixing nip 62.

As described above, such control of the heat amount to be provided to the transfer sheet S in the fixing nip 62 is performed by adjusting the temperature of the fixing nip 62. However, as will be described below, the control may be performed by adjusting the pressure of the fixing nip 62 and the transit time of the transfer sheet S in the fixing nip 62. That is, the heat amount generated by the heater 66 that functions a heat generation means is adjusted based on the temperature rise characteristic of the transfer sheet S acquired by the CPU 91*a* that functions as the temperature rise characteristic acquisition section and provided to the transfer sheet S in the transfer nip 62. Thus, such control may be performed by adjusting at least one of the temperature of the fixing nip 62, the pressure of the fixing nip 62, and the transit time of the transfer sheet S in the fixing nip 62. However, for convenience of description, as illustrated in FIG. 2, the control unit 91 includes the heat source control section 92, the fixing pressure control section 93, and the fixing speed control section 94 in the fixing control section 91*c*, corresponding to the temperature, the pressure, and the transit time, respectively.

In the above described embodiment, the fixing force is stabilized by estimating the basis weight based on the temperature change information and appropriately fitting the temperature of the fixing nip 62 according to the basis weight. However, the fixing force changes even by pressing force of the pressing roller 63 for setting the pressure of the fixing nip 62.

Figure 9:
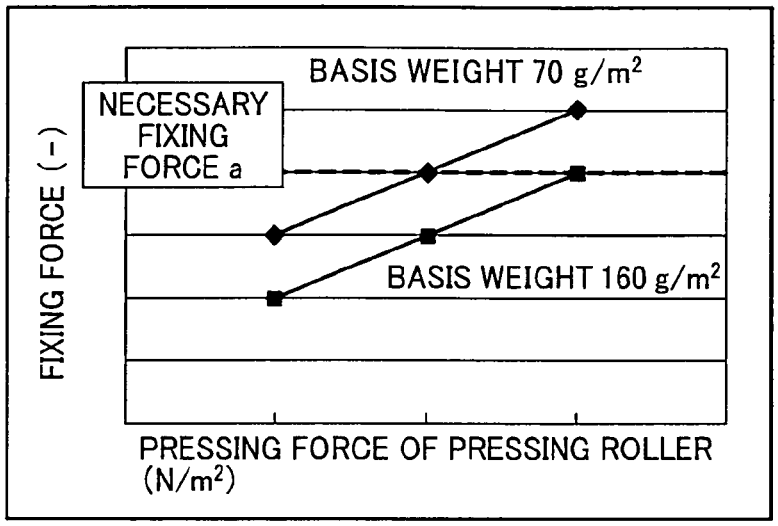
FIG. 9 is a graph illustrating a correlation between pressure of a fixing nip and fixing force.

FIG. 9 illustrates a correlation between the pressing force of the pressing roller 63 and the fixing force when the temperature of the fixing roller 65 is controlled to a certain temperature.

Generally, as illustrated in FIG. 9, to the extent that the pressing force of the pressing roller 63 increases or as the pressure of the fixing nip 62 increases, the fixing force increases. Generally, in order to obtain the same fixing force, to the extent that the basis weight increases, the pressure of the fixing nip 62 needs increase.

Thus, the basis weight of the transfer sheet S is estimated based on the temperature change information and the pressing force of the pressing roller 63 is controlled according to the estimated basis weight, specifically. By setting a target control pressure of the fixing nip 62 and controlling the pressure of the fixing nip 62 so as to become the target control pressure, the cold offset and the hot offset are prevented or suppressed, so that the fixation property is stabilized, and unnecessary power consumption is prevented or suppressed.

For this reason, a relation between the fixing force and the pressing force of the pressing roller 63 on each basis weight is obtained by an experiment as a mathematical formula in advance as follows:

$$y=f(x1,x2)$$

where y denotes the fixing force, x1 denotes a sheet basis weight, and x2 denotes the pressing force of the pressing roller.

In this case, when the basis weight is estimated, the necessary pressing force of the pressing roller 63 is calculated, and the rotation angle of the cam 45 is decided. Thus, if the pressing force of the pressing roller 63 is changed by controlling the rotation angle of the cam 45 to be a target control angle coincident with a target control pressure, the cold offset and the hot offset are prevented or suppressed, so that the fixation property is stabilized, and unnecessary power consumption is prevented or suppressed.

Figure 8:
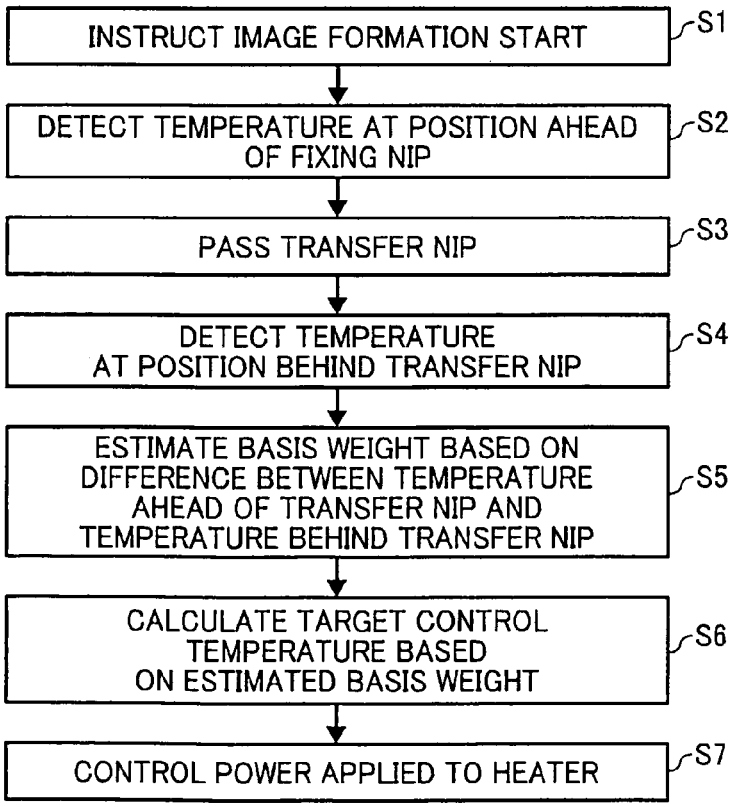
FIG. 8 is a flowchart for performing adjustment of a heat amount provided to a recording medium in a fixing nip, which is performed in the fixing device illustrated in FIG. 1.

In this case, step S6 and step S7 described in FIG. 8 are replaced with step S6 and step S7 described below.

Step S6

Based on the basis weight estimated by the CPU 91*a* that functions as a basis weight estimation section, by the CPU 91*a* a target nip pressure that is a target control pressure is calculated. In this regard, the CPU 91*a* functions as a target nip pressure calculation section that is a target nip pressure calculation means of a target control pressure calculation means.

Step S7

Using the target nip pressure calculated by the CPU 91*a* that functions as the target nip pressure calculation section, the fixing pressure control section 93 as the fixing pressure control means disposed in the fixing control section 91*c* of the control unit 91 decides a pulse number applied to the cam 45 based on information of an angle deviation between the target control angle of the cam 45 and an actual rotation angle and drives the motor 47 by the decided pulse number. As a result, the appropriate heat amount is provided to the transfer sheet S that passes through the fixing nip 62 next time, and thus the cold offset, the hot offset, and unnecessary power consumption are prevented or suppressed.

In this regard of deciding the pulse number, the control unit 91 that functions as the fixing control section 91*c* functions the fixing pressure controller 93*b* as a pressure controller that is a fixing pressure control means of a fixing pressure driving control means that controls the fixing pressure in the fixing pressure control section 93. In this regard of driving the motor 47 using the decided pulse number, the control unit 91 that functions as the fixing control section 91*c* functions as the cam motor driving circuit 93*a* that is a motor driving circuit as a fixing pressure driving means in the fixing pressure control section 93.

In the above described embodiment, the fixing force is stabilized by estimating the basis weight based on the temperature change information and appropriately fitting the temperature or the pressure of the fixing nip 62 according to the basis weight, but the fixing force also change by a time required for the transfer sheet S to pass through the fixing nip 62.

Figure 10:
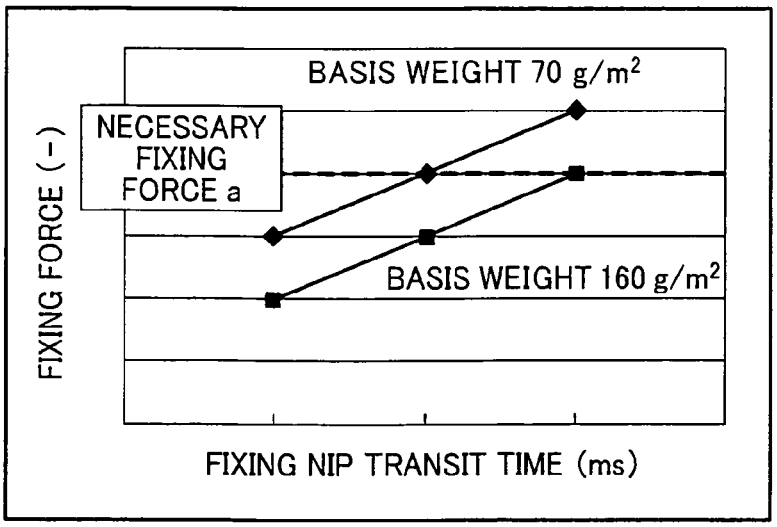
FIG. 10 is a graph illustrating a correlation between a time required for a recording medium to pass through a fixing nip and fixing force.

FIG. 10 illustrates a correlation between the transit time and the fixing force. FIG. 10 illustrates a case in which the temperature and the pressure of the fixing nip 62 are the same.

Generally, as illustrated in FIG. 10, to the extent that the transit time increases, the fixing force increases. Generally, in order to obtain the same fixing force, as the basis weight increases, the transit time needs increase.

Thus, by estimating the basis weight of the transfer sheet S based on the temperature change information and controlling the transit time according to the estimated basis weight, specifically, by setting a target fixing speed that is a target control rotation speed of the fixing roller 65 and controlling the rotation speed of the fixing roller 65 so as to become the target fixing speed, the cold offset and the hot offset are prevented or suppressed, so that the fixation property is stabilized, and unnecessary power consumption is prevented or suppressed.

For this reason, a relation between the fixing force and the transit time on each basis weight is obtained by an experiment in advance.

In this case, when the basis weight is estimated, the necessary transit time is calculated, and the rotation speed of the fixing roller 65 is decided. Thus, if the time required for the transfer sheet S to pass through the fixing nip 62 by controlling the rotation speed of the fixing roller 65 to the target control speed coincident with the target control time is changed, the cold offset and the hot offset are prevented or suppressed, so that the fixation property is stabilized, and unnecessary power consumption is prevented or suppressed.

In this case, step S6 and step S7 described in FIG. 8 are replaced with step S6 and step S7 described below.

Step S6

Based on the basis weight estimated by the CPU 91*a* that functions as the basis weight estimation section, by the CPU 91*a* the target fixing speed coincident with the target control time is calculated. In this regard, the CPU 91*a* functions as a target fixing speed calculation section that is a target fixing speed calculation means of a target control speed calculation means.

Step S7

Using the target fixing seed calculated by the CPU 91*a* that functions as the target fixing speed calculation section, the fixing speed control section 94 as the fixing speed control means disposed in the fixing control section 91*c* of the control unit 91 decides a voltage value applied to the motor 40 based on information of a speed deviation between the target fixing speed of the fixing roller 65 and an actual rotation speed and drives the motor 47 by the decided voltage value. As a result, the appropriate heat amount is provided to the transfer sheet S that passes through the fixing nip 62 next time, and thus the cold offset, the hot offset, and unnecessary power consumption are prevented or suppressed.

In this regard of deciding the voltage value, the control unit 91 that functions as the fixing control section 91*c* functions as the fixing speed controller 94*b* as a speed controller that is a fixing speed control means of a fixing speed driving control means that controls the fixing speed. In this regard of driving the motor 40 using the decided voltage value, the control unit 91 that functions as the fixing control section 91*c* functions as the fixing motor driving circuit 94*a* that is the motor driving circuit as the fixing speed driving means in the fixing speed control section 94.

The examples, in which by the control unit 91 that functions as the fixing control section 91*c* the temperature and the pressure of the fixing nip 62 and the speed of the transfer sheet S that passes through the fixing nip 62 is controlled so that the appropriate heat amount may be provided to the transfer sheet S that passes through the fixing nip 62 have been described. In this regard, the fixing control section 91*c* functions as the fixing heat amount adjusting means that adjusts the heat amount provided to the transfer sheet S in the fixing nip 62 based on the temperature rise characteristic of the transfer sheet S acquired by the CPU 91*a* that functions as the temperature rise characteristic acquisition section of the temperature rise acquisition means. The present embodiment has been described in connection with the case in which the fixing control section 91*c* functions as the fixing heat amount adjusting means is disposed in the control unit 91. However, the fixing control section 91*c* may be disposed in the fixing device 6. The above description has been made in connection with the case in which the temperature and the pressure of the fixing nip 62 and the speed of the transfer sheet S that passes through the fixing nip 62 are controlled single, but the controls may be appropriately combined and used.

The above described has been made in connection with the case in which the temperature rise characteristic is defined by the basis weight, but the temperature rise characteristic may be defined by the amount of moisture content and the smoothness as described already. Even the temperature rise characteristic is decided by the amount of moisture content and the smoothness, similarly to the case in which the temperature rise characteristic is decided by the basis weight, it may be performed. Further, as described above, since the basis weight among the basis weight, the amount of moisture content, and the smoothness is most responsive to the appropriate heat amount provided to the transfer sheet S that passes through the fixing nip 62, it is preferable to decide the temperature rise characteristic using at least the basis weight among the basis weight, the amount of moisture content, and the smoothness. However, the basis weight, the amount of moisture content, and the smoothness may be appropriately combined and used.

The above description has been made in connection with the case in which the temperature change information is acquired based on the temperatures of the transfer sheet S detected before and after passing through the fixing nip 62. However, the temperature change information may be acquired based on the temperature of the transfer sheet S detected after passing through the fixing nip 62.

Figure 11:
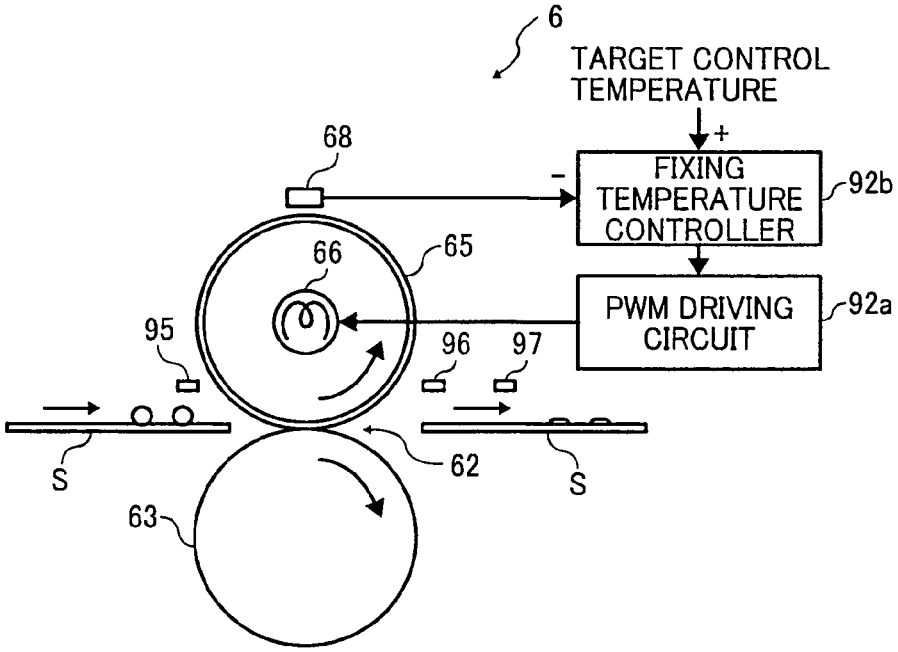
FIG. 11 is a schematic front view illustrating another configuration example of a fixing device according to the invention.

FIG. 11 illustrates an example of a fixing device that acquires the temperature change information based on the temperature of the transfer sheet S detected after passing through the fixing nip 62.

The fixing device 6 includes the sensor 96 that is a first post-fixing temperature sensor and a sensor 97 that is a second post-fixing temperature sensor, which are disposed as post-fixing temperature sensors, respectively, from an upstream side of the same direction behind the fixing nip 62 in the conveying direction of the transfer sheet S. The sensor 96 is the same sensor 96 illustrated in FIG. 4 and is a radiation type temperature sensor that measures the temperature of the transfer sheet S in a non-contact manner. The sensor 97 is also a radiation type temperature sensor that measures the temperature of the transfer sheet S in a non-contact manner.

Figure 12:
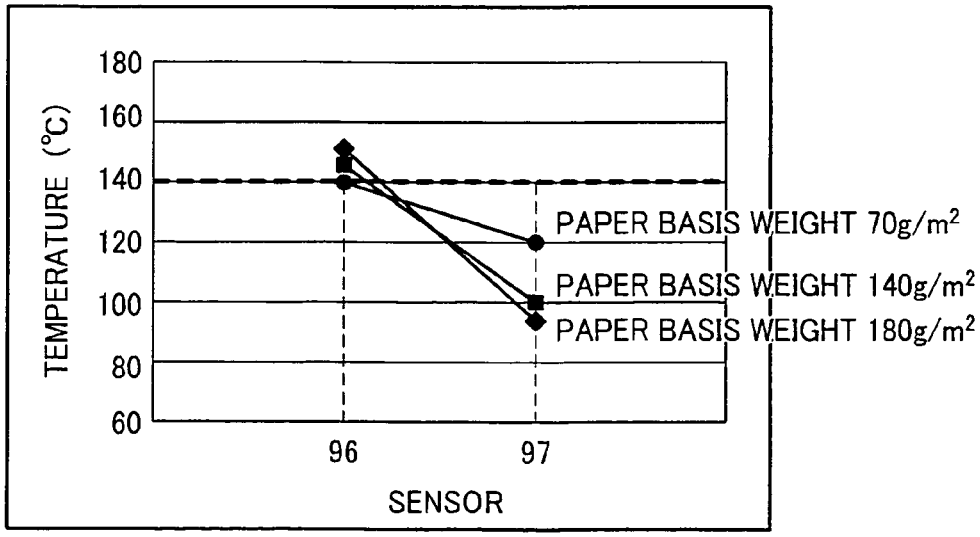
FIG. 12 is a graph illustrating a correlation between a detected temperature and a basis weight of a recording medium in the fixing device illustrated in FIG. 11.

FIG. 12 illustrates the temperatures that are detected and acquired by the sensors 96 and 97 after fixing. After fixing, the heat amount received in the fixing nip 62 is diffused into the inside of the transfer sheet S and radiated to the ambient, and thus the temperature of the transfer sheet S falls as a time elapses.

The degree of temperature drop is steep as the basis weight is large. This is because to the extent that the basis weight increases, the heat quantity is increasingly diffused to the inside of the transfer sheet S.

Thus, the basis weight may accurately be estimated by measuring the temperature drop of the transfer sheet S through the plurality of sensors 96 and 97 after fixing.

Further, to the extent that the amount of moisture content increases, since the vaporization heat by evaporation increases, the degree of the temperature drop of the transfer sheet S after fixing is steep. To the extent that the smoothness is rougher, since an area in which heat radiation is performed increases, the degree of the temperature drop of the transfer sheet S after fixing is steep. Thus, by measuring the temperature drop, the amount of moisture content and the smoothness may accurately be estimated. Here, an example of estimating the basis weight will be described.

The degree of the temperature drop of the transfer sheet S after passing through the fixing nip 62, that is, a relation between a temperature difference Δt2 obtained by subtracting the temperature of the transfer sheet S, which is distant from the fixing nip 62 and large in degree of the temperature drop, detected by the sensor 97 from the temperature of the transfer sheet S, which is near to the fixing nip 62 and small in degree of the temperature drop, detected by the sensor 96 and the basis weight w of the transfer sheet S is obtained experimentally as a mathematical formula in advance as follows.

$$w=(\Delta t2+1.9355)/0.3226$$

Thus, by measuring the temperature difference Δt2 using the above formula, the basis weight w of the transfer sheet S is estimated. As described above, by appropriately changing the target control value such as the target control temperature of the fixing roller 65 according to the estimated basis weight, the appropriate heat amount is provided to the transfer sheet S that passes through the fixing nip 62, so that the cold offset, the hot offset, and unnecessarily power consumption are prevented or suppressed.

In this case, the temperature difference Δt2 corresponds to the temperature change information calculated by the CPU 91*a* that functions as the temperature change information acquisition section. Further, the temperatures of the transfer sheet S detected by the sensors 96 and 97 are stored in the memory section 91*b* of the control unit 91 that functions as the detection temperature storage means. Particularly, the memory section 91*b* that functions as the detection temperature storage means functions as an upstream side post-fixing detection temperature storage means related to the storage of the temperature detected by the sensor 96 and functions as a downstream side post-fixing detection temperature storage means related to the storage of the temperature detected by the sensor 97. The CPU 91*a* functions as the temperature change information acquisition section as the temperature change information acquisition means. Based on the temperature change information acquired by the CPU 91*a* that functions as the temperature change information acquisition section, the CPU 91*a* that functions as the temperature rise characteristic acquisition section as the temperature rise characteristic acquisition means extracts, specifies, and acquires the temperature rise characteristic of the transfer sheet S. In addition, acquisition and estimation of the temperature rise characteristic by the CPU 91*a* that functions as the temperature rise characteristic acquisition section are performed in the same manner as described above.

FIG. 11 has been described in connection with the case in which the temperature change information is acquired based on the temperatures of the transfer sheet S detected by the two sensors 96 and 97. However, three or more sensors including the same sensor 95 as the sensor 95 illustrated in FIG. 4 may be used as illustrated in FIG. 11, and thus the basis weight may be estimated with the high degree of accuracy. In the case of using three or more sensors, all of the sensors may be disposed behind the transfer nip 62 in the conveying direction of the transfer sheet S. In order to acquire the temperature change information with the high degree of accuracy, at least one of a plurality of sensors is preferably disposed behind the fixing nip 62 in the conveying direction of the transfer sheet S.

The control unit 91 stores, in the memory section 91*b*, a fixing condition control program for a fixing condition control method of adjusting the heat amount provided to the transfer S in the fixing nip 62 based on the temperature rise characteristic acquired by the CPU 91*a* that functions as the temperature rise characteristic acquisition section by using the CPU 91*a* that functions as the temperature rise characteristic acquisition section that acquires the temperature rise characteristic of the transfer sheet S based on the temperature change information of the transfer sheet S acquired on the basis of the temperatures of the transfer sheet S detected by an appropriate combination of the sensors 95, 96, and 97 described above. In this regard, the control unit 91 or the memory section 91*b* functions a fixing condition control program storage means. The fixing condition control program may be stored in a semiconductor medium (for example, a ROM, a non-volatile memory, etc.), an optical medium (for example, a DVD, a MO, a MD, a CD-R, etc.), a magnetic medium (for example, a hard disk, a magnetic tape, a flexible disk, etc.), or other storage medias as well as the memory section 91*b* disposed in the control unit 91. When the memory or other storage media store the fixing condition control program, the memory or other storage media constitute a computer readable recording medium storing the fixing condition control program.

The exemplary embodiment of the invention has been described above, but the invention is not limited to the above embodiment. Unless particularly limited in the above description, various modifications or changes may be made within the scope of the invention stated in the claims.

For example, the invention may be applied to a lower heat capacity fixing device such as a belt fixing type fixing device other than a roller fixing type fixing device described above. Applying the invention to the lower heat capacity fixing device is particularly effective. The lower heat capacity fixing device has an advantage in that a warm-up time is short, and power consumption is low. However, due to a characteristic that is easily warmed up and easily cooled down, the temperature of the fixing member, that is, the temperature of the fixing nip is difficult to be stabilized. For this reason, it is difficult to stabilize the fixing image quality compared to the conventional roller fixing type fixing device.

Thus, in the lower heat capacity fixing device that is essentially difficult to stabilize the fixing image quality, by estimating the basis weight and changing the fixing condition according to the basis weight, the appropriate heat amount is provided to the recording medium that passes through the fixing nip. Thus, the cold offset and the hot offset are prevented or suppressed, so that it is very effective in stabilizing the fixation property and preventing or suppressing unnecessary power consumption.

Figure 13:
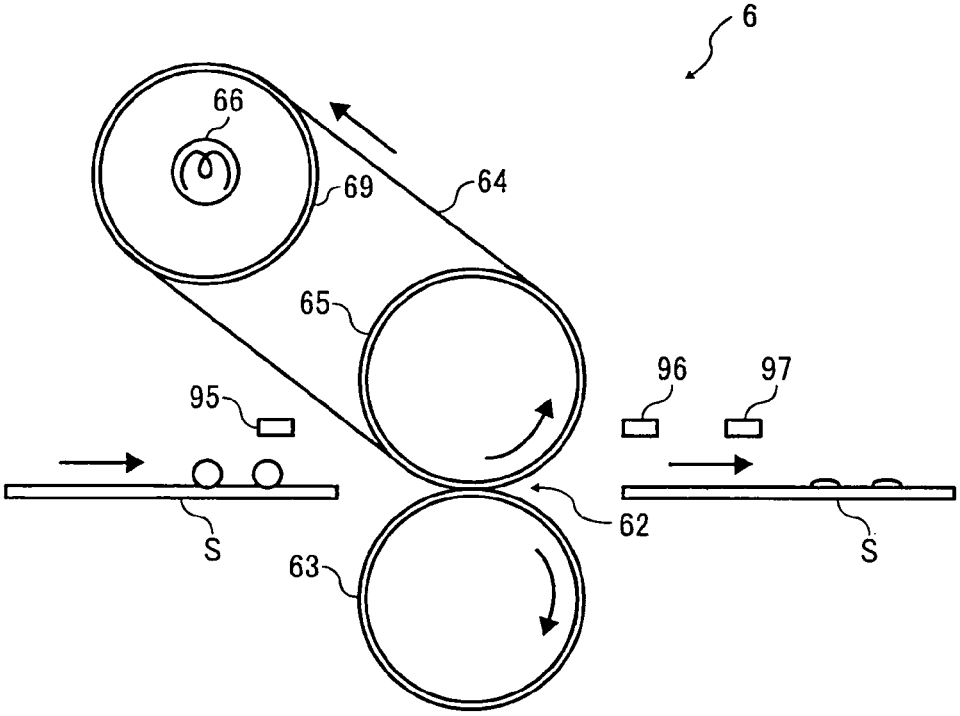
FIG. 13 is a schematic front view illustrating still another configuration example of a fixing device according to the invention.

FIG. 13 illustrates a belt fixing type fixing device, as a representative model of a lower heat capacity fixing device, which is a fixing device according to the invention. In the fixing device, the same components as disposed in the above described fixing device are denoted by the same reference numerals, and an illustration thereof and a description thereof will not be repeated.

The fixing device 6 includes an endless belt type fixing belt 64 as a fixing member, the fixing roller 65 which the fixing belt 64 is wounded and stretched over, a heating roller 69 that stretches the fixing belt 64 together with the fixing roller 65, has a function of heating the fixing belt 64, and also functions as a tension roller for constant maintain of a tension of the fixing belt 64, the pressing roller 63 as a roller type pressing member for forming the fixing nip 62 as a fixing member that is a press-contact section that comes in press-contact with the fixing belt 64 therebetween with the fixing roller 65 and presses the transfer sheet S, and the heater 66 that is a halogen heater as a heat generation means that is a fixing heat source that is a heat source as a heating means that is disposed in the heating roller 69, for heating the fixing nip 62 to a predetermined temperature by heating the heating roller 69 and heating the fixing belt 64.

The fixing belt 64 is excellent in heat resistance, is made of a material with high durability, and has the thickness of tens of microns. For this reason, the heat capacity of the fixing belt 64 is small, and it is relatively difficult to stabilize the temperature thereof. However, by acquiring the temperature change information using the sensors 95, 96, and 97 appropriately, acquiring the temperature rise characteristic, and performing control for adjusting the heat amount provided to the transfer sheet S in the fixing nip 62, the appropriate heat amount is provided to the transfer sheet S that passes through the fixing nip 62. Thus, the cold offset and the hot offset are prevented or suppressed, so that the fixation property is stabilized, and unnecessarily power consumption is prevented or suppressed. Accordingly, the effectiveness of applying such control greatly increases.

Further, the invention is particularly effective when applying to a high speed startup fixing device by heating using electromagnetic induction (IH) instead of heating by the halogen heater as the heat source. A high speed startup device has an advantage in that the warm-up time is short, and power consumption is low. However, since the temperature rising speed is fast, the temperature of the fixing member, that is, the temperature of the fixing nip is difficult to be stabilized. For this reason, it is more difficult to stabilize the fixing image quality compared to the conventional fixing device using heating by the halogen heater.

Thus, in the high speed startup device that performs heat source supply by electromagnetic induction, by estimating the basis weight and changing the fixing condition according to the basis weight, the appropriate heat amount is provided to the recording medium that passes through the fixing nip. Thus, the cold offset and the hot offset are prevented or suppressed, so that it is very effective in stabilizing the fixation property and preventing and suppressing unnecessarily power consumption.

Figure 14:
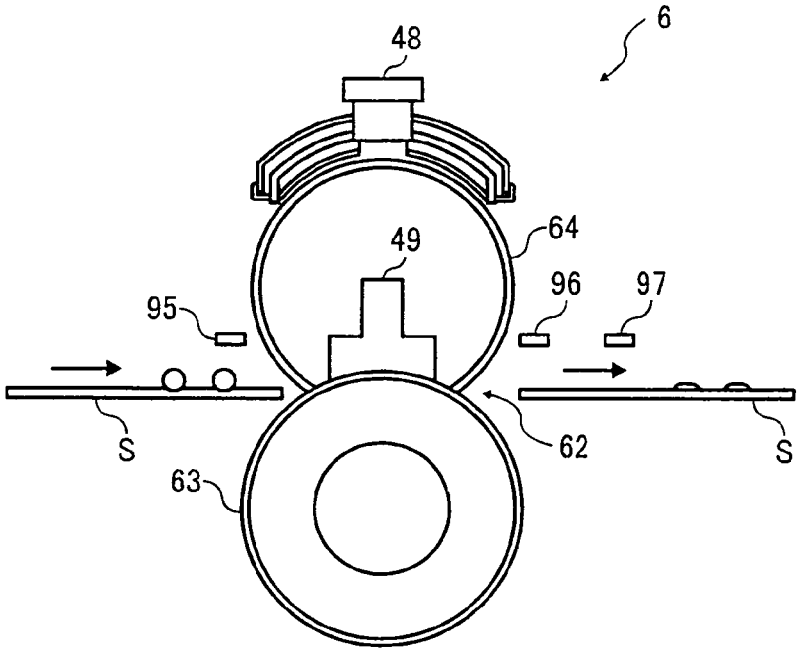
FIG. 14 is a schematic front view illustrating still another configuration example of a fixing device according to the invention.

FIG. 14 illustrates a fixing device having a configuration in which a film-like fixing member is heated by an external IH heat source as a fixing device according to the invention. In the fixing device, the same components as disposed in the above described fixing device are denoted by the same reference numerals, and an illustration thereof and a description thereof will not be repeated.

The fixing device 6 includes the film-like fixing belt 64 as a fixing member, an IH heat source 48 that is a heat source as a heating means that is disposed above the fixing belt 64 and heats the fixing belt 64 from the outside by electromagnetic induction, and a nip forming member 49 that is disposed inside the fixing belt 64 and forms the fixing nip 62 therebetween with the pressing roller 63. The reason why the IH heat source 48 is disposed outside the fixing belt 64 and the fixing belt 64 is heated from the outside is to realize temperature rise at a higher speed. The IH heat source 48 may be disposed inside the fixing belt 64.

In the fixing device 6, the fixing belt 64 has a small heat capacity, and the temperature rising speed is very fast due to heat amount supply by the external IH heat source 48. However, since the fixing belt 64 has a small heat capacity, it is relatively difficult to stabilize the temperature thereof. However, by acquiring the temperature change information using the sensors 95, 96, and 97 appropriately, acquiring the temperature rise characteristic, and performing control for adjusting the heat amount provided to the transfer sheet S in the fixing nip 62, the appropriate heat amount is provided to the transfer sheet S that passes through the fixing nip 62. Thus, the cold offset and the hot offset are prevented or suppressed, so that the fixation property is stabilized, and unnecessarily power consumption is prevented or suppressed. Accordingly, the effectiveness of applying such control greatly increases.

The above embodiments have been described in connection with the case in which the fixing device includes the temperature detection means for obtaining the temperature change information of the recording medium. However, the invention is not limited to the example in which the temperature detection means is disposed in the fixing device, and the temperature detection means may be disposed at the main body side of the image forming device. For example, an environment temperature sensor generally disposed in the image forming apparatus may be used as the temperature detection means for obtaining the temperature change information. This is because the temperature of the recording medium corresponds to or is almost equal to the temperature inside the image forming device. However, since it is preferable that the temperature detection means disposed at the downstream side of the fixing nip in the conveying direction of the recording medium is disposed at a position relatively close to the fixing nip in order to obtain the temperature change information, the temperature detection means is preferably disposed in the fixing device. However, since the temperature change to be subject from the feeding device to the fixing device is relatively smaller than the temperature change to be subject in the fixing nip, the arrangement position of the temperature detection means disposed at the upstream side of the fixing nip in the conveying direction of the recording medium is relatively free. Thus, when the temperature change information of the recording medium is obtained using the temperature detection means disposed at the upstream side and the downstream side of the fixing nip in the conveying direction of the recording medium, if an existing temperature detection means disposed at the main body side of the image forming apparatus is used as the temperature detection means at the upstream side of the fixing nip like the environment temperature sensor, the temperature detected by the existing temperature detection means is used as the temperature of the recording medium, and a temperature detection means disposed in the fixing device is used as the temperature detection means at the downstream side of the fixing nip, the temperature change information of the recording medium may be obtained only by disposing a new temperature detection means in the fixing device. In this case, there is an advantage because the cost may be reduced, and the control for obtaining the temperature may be simplified.

The image forming apparatus may employ a direct transfer type other than an indirect transfer type described above even though it is of a tandem type. The image forming apparatus of the direct transfer type includes a sheet conveying belt that is a recording medium conveying body as an image carrier instead of the above-described transfer belt 11 and transfers the toner images of the respective colors formed in the image forming unit 60BK, 60C, 60M, and 60Y on the transfer sheet that is being converted by the sheet conveying belt in a superimposed manner.

Further, the image forming apparatus may similarly be applied to a single drum type image forming apparatus, which obtains a color image by sequentially forming toner images of respective colors on one photoreceptor drum and sequentially superimposing the toner images of the respective colors, other than a tandem type image forming apparatus.

Further, a color image forming apparatus such as a color copy machine or a color printer is recently increasingly demanded by a market, but as the image forming apparatus, an image forming apparatus that may form only a monochromatic image may be used.

The developer used in the image forming apparatus is not limited to the two-component developer but may include a one-component developer. An image fixed onto the recording medium by the fixing device is not limited to an image formed by the toner but may include an image formed by any other image forming material such as ink. As the image forming apparatus, an image forming apparatus that that forms an image on an appropriate image forming material that requires fixing as described above may be used.

As the image forming apparatus, a single body of a copy machine, a printer, or a facsimile other than a multifunction peripheral may be used. Further, a multifunction peripheral of any other combination such as a multifunction peripheral of a copy machine and a printer may be used.

The effects stated in the embodiments of the invention are exemplary effects of the invention, and the effects of the invention are not limited to ones stated in the embodiments of the invention.

According to an aspect of the present invention, a fixing device may stably perform excellent fixing by improving a degree of accuracy with which a temperature rise characteristic is acquired, appropriately heating a recording medium in a fixing nip according to the acquired temperature rise characteristic of the recording medium and thus contribute to excellent image formation, and reduce unnecessary energy at the time of fixing.

According to another aspect of the present invention, an image forming apparatus may stably perform excellent fixing by improving the degree of accuracy with which the temperature rise characteristic is acquired, appropriately heating the recording medium in the fixing nip according to the acquired temperature rise characteristic of the recording medium, thus contribute to excellent image formation, and reduce unnecessary energy at the time of image formation.

According to another aspect of the present invention, a fixing condition control method may stably perform excellent fixing by improving the degree of accuracy with which the temperature rise characteristic is acquired, appropriately heating the recording medium in the fixing nip according to the acquired temperature rise characteristic of the recording medium, thus contribute to excellent image formation, further reduce unnecessary energy at the time of fixing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device, comprising:

a temperature rise characteristic acquisition unit that acquires a temperature rise characteristic of a recording medium, the recording medium being a cut sheet, based on temperature change information of the recording medium acquired on a temperature basis of the recording medium detected by a temperature detection unit that detects the temperature of the recording medium; and a heat generation unit that generates a heat amount provided to the recording medium in a fixing nip for fixing an image carried on the recording medium, that is adjusted on the basis of the temperature rise characteristic acquired by the temperature rise characteristic acquisition unit, wherein the temperature detection unit includes a plurality of sensors arranged downstream of the fixing device in a recording medium transport direction, the temperature rise characteristic acquisition unit acquires the temperature rise characteristic based on the temperature change information acquired on the basis of the temperature of the recording medium detected by the temperature detection unit before and after passing through the fixing nip, the temperature rise characteristic acquisition unit estimates a basis weight of the recording medium that passes through the fixing nip, based on a degree of the temperature drop of the recording medium that is a temperature difference between temperatures detected by at least two sensors among the plurality of sensors arranged downstream of the fixing nip, and a relational data of the degree of the temperature drop and the basis weight of the recording medium determined in advance, and the heat generation unit controls the heat amount provided to the recording medium in the fixing nip in accordance with the estimated basis weight.

2. The fixing device according to claim 1, wherein the temperature detection unit that detects the temperature of the recording medium before passing through the fixing nip is disposed on a main body of an image forming apparatus having the fixing device, and the temperature detection unit that detects the temperature of the recording medium after passing through the fixing nip is disposed in the fixing device.

3. The fixing device according to claim 1, wherein the temperature detection unit that detects the temperature of the recording medium after passing through the fixing nip is disposed in the fixing device.

4. The fixing device according to claim 1, wherein the temperature rise characteristic acquired by the temperature rise characteristic acquisition unit is decided by a heat capacity of the recording medium.

5. The fixing device according to claim 4, wherein the heat capacity is decided by a basis weight of the recording medium.

6. The fixing device according to claim 4, wherein the heat capacity is decided by an amount of moisture content of the recording medium.

7. The fixing device according to claim 1, wherein the temperature rise characteristic acquired by the temperature rise characteristic acquisition unit is decided by thermal absorbability of the recording medium.

8. The fixing device according to claim 7, wherein the thermal absorbability is decided by smoothness of the recording medium.

9. The fixing device according to claim 1, wherein the heat amount is adjusted by adjusting at least one of a temperature of the fixing nip, a pressure of the fixing nip, and a transit time of the recording medium in the fixing nip.

10. The fixing device according to claim 1, further comprising:

a fixing member that forms the fixing nip, wherein the fixing member is an endless fixing belt.

11. The fixing device according to claim 1, further comprising:

a heating unit that heats the fixing nip by electromagnetic induction.

12. The fixing device according to claim 1, wherein, when there is detected, by a detection unit, a state in which the recording medium, which is accommodated in a feed unit that accommodates the recording medium and feeds the accommodated recording medium toward the fixing nip, has been replaced, the temperature rise characteristic is acquired by the temperature rise characteristic acquisition unit, and the heat amount is adjusted on the basis of the temperature rise characteristic acquired by the temperature rise characteristic acquisition unit.

13. The fixing device according to claim 1, wherein, when the recording medium that has passed through the fixing nip passes through the fixing nip again and is subjected to the fixing, the temperature rise characteristic is acquired by the temperature rise characteristic acquisition unit when passing through the fixing nip a first time, and the heat amount is adjusted on the basis of the temperature rise characteristic acquired by the temperature rise characteristic acquisition unit when the fixing is performed on the other side.

14. The fixing device according to claim 1, wherein the temperature rise characteristic acquisition unit acquires the temperature rise characteristic based on a difference between the temperature of the recording medium detected by the temperature detection unit before and after passing through the fixing device.

15. The fixing device according to claim 1, wherein the temperature detection unit that detects the temperature of the recording medium before the recording medium passes through the fixing device is arranged upstream of the fixing device and downstream of a transfer section, in a recording medium transport direction.

16. The fixing device according to claim 1, wherein the temperature detection unit includes the plurality of sensors and a least one sensor is arranged upstream of the fixing device and at least one sensor is arranged downstream of the fixing device, in a recording medium transport direction.

17. An image forming apparatus, comprising:

a fixing device including:

a temperature rise characteristic acquisition unit that acquires a temperature rise characteristic of a recording medium, the recording medium being a cut sheet, based on temperature change information of the recording medium acquired on a temperature basis of the recording medium detected by a temperature detection unit that detects the temperature of the recording medium, the temperature detection unit includes a plurality of sensors arranged downstream of the fixing device in a recording medium transport direction; and a heat generation unit that generates a heat amount that is adjusted on the basis of the temperature rise characteristic of the recording medium acquired by the temperature rise characteristic acquisition unit, that is provided to the recording medium in a fixing nip for fixing an image carried on the recording medium, wherein the temperature rise characteristic acquisition unit acquires the temperature rise characteristic based on the temperature change information acquired on the basis of the temperature of the recording medium detected by the temperature detection unit before and after passing through the fixing nip, the temperature rise characteristic acquisition unit estimates a basis weight of the recording medium that passes through the fixing nip, based on a degree of the temperature drop of the recording medium that is a temperature difference between temperatures detected by at least two sensors among the plurality of sensors arranged downstream of the fixing nip, and a relational data of the degree of the temperature drop and the basis weight of the recording medium determined in advance, and the heat generation unit controls the heat amount provided to the recording medium in the fixing nip in accordance with the estimated basis weight.

18. A method of controlling fixing conditions, comprising:

performing, by a temperature rise characteristic acquisition unit, acquisition of a temperature rise characteristic of a recording medium, the recording medium being a cut sheet, based on temperature change information of the recording medium acquired on a temperature basis of the recording medium detected by a temperature detection unit that detects the temperature of the recording medium, the temperature detection unit includes a plurality of sensors arranged downstream of the fixing device in a recording medium transport direction;

adjusting a heat amount provided to the recording medium in a fixing nip for fixing an image carried on the recording medium based on the temperature rise characteristic acquired by the temperature rise characteristic acquisition unit, wherein the temperature rise characteristic acquisition unit acquires the temperature rise characteristic based on the temperature change information acquired on the basis of the temperature of the recording medium detected by the temperature detection unit before and after passing through the fixing nip;

estimating a basis weight of the recording medium that passes through the fixing nip, based on a degree of the temperature drop of the recording medium that is a temperature difference between temperatures detected by at least two sensors among the plurality of sensors arranged downstream of the fixing nip, and a relational data of the degree of the temperature drop and the basis weight of the recording medium determined in advance; and controlling the heat amount provided to the recording medium in the fixing nip in accordance with the estimated basis weight.

* * * * *